US007185710B2

(12) United States Patent
Cook et al.

(10) Patent No.: US 7,185,710 B2
(45) **Date of Patent: *Mar. 6, 2007**

(54) MONO-DIAMETER WELLBORE CASING

(75) Inventors: Robert Lance Cook, Katy, TX (US); Lev Ring, Houston, TX (US)

(73) Assignee: Enventure Global Technology, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/465,835

(22) Filed: Jun. 13, 2003

(65) Prior Publication Data

US 2004/0118574 A1 Jun. 24, 2004

Related U.S. Application Data

(63) Continuation-in-part of application No. 10/418,687, filed on Apr. 18, 2003, now Pat. No. 7,021,390, which is a continuation of application No. 09/852,026, filed on May 9, 2001, now Pat. No. 6,561,227, which is a continuation of application No. 09/454,139, filed on Dec. 3, 1999, now Pat. No. 6,497,289.

(60) Provisional application No. 60/262,434, filed on Jan. 17, 2001, provisional application No. 60/111,293, filed on Dec. 7, 1998.

(51) Int. Cl.
*E21B 23/06* (2006.01)

(52) U.S. Cl. ..... 166/384; 166/206; 166/207; 166/382

(58) Field of Classification Search ..... 166/206, 166/207, 382, 384
See application file for complete search history.

(56) References Cited

U.S. PATENT DOCUMENTS 46,818 A 3/1865 Patterson (Continued)

FOREIGN PATENT DOCUMENTS

AU 767364 2/2004

(Continued)

OTHER PUBLICATIONS

Letter From Baker Oil Tools to William Norvell in Regards to Enventure's Claims of Baker Infringement Of Enventure's Expandable Patents Apr. 1, 2005.

(Continued)

*Primary Examiner*—Jennifer H. Gay
(74) *Attorney, Agent, or Firm*—Haynes and Boone LLP; Todd Mattingly

(57) ABSTRACT

A mono-diameter wellbore casing. A tubular liner and an expansion cone are positioned within a new section of a wellbore with the tubular liner in an overlapping relationship with a pre-existing casing. A hardenable fluidic material is injected into the new section of the wellbore below the level of the expansion cone and into the annular region between the tubular liner and the new section of the wellbore. The inner and outer regions of the tubular liner are then fluidicly isolated. A non hardenable fluidic material is then injected into a portion of an interior region of the tubular liner to pressurize the portion of the interior region of the tubular liner below the expansion cone. The tubular liner is then extruded off of the expansion cone. The overlapping portion of the pre-existing casing and the tubular liner are then radially expanded using an expansion cone.

54 Claims, 15 Drawing Sheets

U.S. PATENT DOCUMENTS

| | | | |
|---|---|---|---|
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,494,128 | A | 5/1924 | Primrose |
| 1,589,781 | A | 6/1926 | Anderson |
| 1,590,357 | A | 6/1926 | Feisthamel |
| 1,597,212 | A | 8/1926 | Spengler |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,214,226 | A | 9/1940 | English |
| 2,226,804 | A | 12/1940 | Carroll |
| 2,273,017 | A | 2/1942 | Boynton |
| 2,301,495 | A | 11/1942 | Abegg |
| 2,371,840 | A | 3/1945 | Otis |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,627,891 | A | 2/1953 | Clark |
| 2,647,847 | A | 8/1953 | Black et al. |
| 2,734,580 | A | 2/1956 | Layne |
| 2,796,134 | A | 6/1957 | Binkley |
| 2,812,025 | A | 11/1957 | Teague et al. |
| 2,907,589 | A | 10/1959 | Knox |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,371,717 | A | 3/1968 | Chenoweth |
| 3,427,707 | A | 2/1969 | Nowosadko |
| 3,504,515 | A | 4/1970 | Reardon |
| 3,520,049 | A | 7/1970 | Lysenko et al. |
| 3,528,498 | A | 9/1970 | Carothers |
| 3,578,081 | A | 5/1971 | Bodine |
| 3,579,805 | A | 5/1971 | Kast |
| 3,605,887 | A | 9/1971 | Lambie |
| 3,631,926 | A | 1/1972 | Young |
| 3,667,547 | A | 6/1972 | Ahlstone |
| 3,687,196 | A | 8/1972 | Mullins |
| 3,709,306 | A | 1/1973 | Curington |
| 3,781,966 | A | 1/1974 | Lieberman |
| 3,834,742 | A | 9/1974 | McPhillips |
| 3,942,824 | A | 3/1976 | Sable |
| 3,989,280 | A | 11/1976 | Schwarz |
| 4,019,579 | A | 4/1977 | Thuse |
| 4,069,573 | A | 1/1978 | Rogers et al. |
| 4,125,937 | A | 11/1978 | Brown et al. |
| 4,168,747 | A | 9/1979 | Youmans |
| 4,205,422 | A | 6/1980 | Hardwick |
| 4,226,449 | A | 10/1980 | Cole |
| 4,257,155 | A | 3/1981 | Hunter |
| 4,328,983 | A | 5/1982 | Gibson |
| 4,355,664 | A | 10/1982 | Cook et al. |
| 4,384,625 | A | 5/1983 | Roper et al. |
| 4,388,752 | A | 6/1983 | Vinciguerra et al. |
| 4,401,325 | A | 8/1983 | Tsuchiya et al. |
| 4,422,317 | A | 12/1983 | Mueller |
| 4,422,507 | A | 12/1983 | Reimert |
| 4,442,586 | A | 4/1984 | Ridenour |
| 4,449,713 | A | 5/1984 | Ishido et al. |
| 4,467,630 | A | 8/1984 | Kelly |
| 4,468,309 | A | 8/1984 | White |
| 4,491,001 | A | 1/1985 | Yoshida |
| 4,505,987 | A | 3/1985 | Yamada et al. |
| 4,507,019 | A | 3/1985 | Thompson |
| 4,526,839 | A | 7/1985 | Herman et al. |
| 4,530,231 | A | 7/1985 | Main |
| 4,541,655 | A | 9/1985 | Hunter |
| 4,550,782 | A | 11/1985 | Lawson |
| 4,581,817 | A | 4/1986 | Kelly |
| 4,595,063 | A | 6/1986 | Jennings et al. |
| 4,601,343 | A | 7/1986 | Lindsey et al. |
| 4,614,233 | A | 9/1986 | Menard |
| 4,649,492 | A | 3/1987 | Sinha et al. |
| 4,651,836 | A | 3/1987 | Richards |
| 4,674,572 | A | 6/1987 | Gallus |
| 4,754,781 | A | 7/1988 | Putter |
| 4,758,025 | A | 7/1988 | Frick |
| 4,778,088 | A | 10/1988 | Miller |
| 4,779,445 | A | 10/1988 | Rabe |
| 4,817,712 | A | 4/1989 | Bodine |
| 4,826,347 | A | 5/1989 | Baril et al. |
| 4,832,382 | A | 5/1989 | Kapgan |
| 4,836,579 | A | 6/1989 | Wester et al. |
| 4,842,082 | A | 6/1989 | Springer |
| 4,848,459 | A | 7/1989 | Blackwell et al. |
| 4,854,338 | A | 8/1989 | Grantham |
| 4,856,592 | A | 8/1989 | Van Bilderbeek et al. |
| 4,871,199 | A | 10/1989 | Ridenour et al. |
| 4,904,136 | A | 2/1990 | Matsumoto |
| 4,915,177 | A | 4/1990 | Claycomb |
| 4,915,426 | A | 4/1990 | Skipper |
| 4,917,409 | A | 4/1990 | Reeves |
| 4,919,989 | A | 4/1990 | Colangelo |
| 4,930,573 | A | 6/1990 | Lane et al. |
| 4,938,291 | A | 7/1990 | Lynde et al. |
| 4,942,925 | A | 7/1990 | Themig |
| 4,995,464 | A | 2/1991 | Watkins et al. |
| 5,031,370 | A | 7/1991 | Jewett |
| 5,064,004 | A | 11/1991 | Lundell |
| 5,134,891 | A | 8/1992 | Canevet |
| 5,150,755 | A | 9/1992 | Cassel et al. |
| 5,156,213 | A | 10/1992 | George et al. |
| 5,195,583 | A | 3/1993 | Toon et al. |

5,242,017 A 9/1993 Hailey
5,253,713 A 10/1993 Gregg et al.
5,275,242 A 1/1994 Payne
5,282,508 A 2/1994 Ellingsen et al.
5,306,101 A 4/1994 Rockower et al.
5,309,621 A 5/1994 ODonnell et al.
5,314,014 A 5/1994 Tucker
5,326,137 A 7/1994 Lorenz et al.
5,327,964 A 7/1994 ODonnell et al.
5,337,827 A 8/1994 Hromas et al.
5,360,239 A 11/1994 Klementich
5,400,827 A 3/1995 Baro et al.
5,413,180 A 5/1995 Ross et al.
5,431,831 A 7/1995 Vincent
5,456,319 A 10/1995 Schmidt et al.
5,458,194 A 10/1995 Brooks
5,492,173 A 2/1996 Kilgore et al.
5,554,244 A 9/1996 Ruggles et al.
5,566,772 A 10/1996 Coone et al.
5,584,512 A 12/1996 Carstensen
5,662,180 A 9/1997 Coffman et al.
5,697,449 A 12/1997 Hennig et al.
5,738,146 A 4/1998 Abe
5,743,335 A 4/1998 Bussear
5,749,419 A 5/1998 Coronado et al.
5,749,585 A 5/1998 Lembcke
5,862,866 A 1/1999 Springer
5,895,079 A 4/1999 Carstensen et al.
5,944,108 A 8/1999 Baugh et al.
5,971,443 A 10/1999 Noel et al.
5,975,587 A 11/1999 Wood et al.
6,012,521 A 1/2000 Zunkel et al.
6,056,324 A 5/2000 Reimert et al.
6,073,692 A 6/2000 Wood et al.
6,138,761 A 10/2000 Freeman et al.
6,158,963 A 12/2000 Hollis et al.
6,167,970 B1 1/2001 Stout
6,231,086 B1 5/2001 Tierling
6,263,966 B1 7/2001 Haut et al.
6,263,972 B1 7/2001 Richard et al.
6,267,181 B1 7/2001 Rhein Knudsen et al.
6,275,556 B1 8/2001 Kinney et al.
6,318,457 B1 11/2001 Den Boer et al.
6,318,465 B1 11/2001 Coon et al.
6,325,148 B1 12/2001 Trahan et al.
6,343,495 B1 2/2002 Cheppe et al.
6,343,657 B1 2/2002 Baugh et al.
6,345,373 B1 2/2002 Chakradhar et al.
6,390,720 B1 5/2002 LeBegue et al.
6,405,761 B1 6/2002 Shimizu et al.
6,406,063 B1 6/2002 Pfeiffer
6,419,025 B1 7/2002 Lohbeck et al.
6,419,026 B1 7/2002 MacKenzie et al.
6,431,277 B1 8/2002 Cox et al.
6,450,261 B1 9/2002 Baugh
6,464,008 B1 10/2002 Roddy et al.
6,464,014 B1 10/2002 Bernat
6,470,996 B1 10/2002 Kyle et al.
6,478,092 B2 11/2002 Voll et al.
6,491,108 B1 12/2002 Slup et al.
6,516,887 B2 2/2003 Nguyen et al.
6,543,545 B1 4/2003 Chatterji et al.
6,543,552 B1 4/2003 Metcalfe et al.
6,550,539 B2 4/2003 Maguire et al.
6,561,279 B2 5/2003 MacKenzie et al.
6,568,488 B2 5/2003 Wentworth et al.
6,591,905 B2 7/2003 Coon
6,598,677 B1 7/2003 Baugh et al.
6,598,678 B1 7/2003 Simpson et al.
6,607,220 B2 8/2003 Sivley
6,619,696 B2 9/2003 Baugh et al.
6,622,797 B2 9/2003 Sivley
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price Smith et al.
6,722,427 B2 4/2004 Gano et al.
6,722,437 B2 4/2004 Vercaemer et al.
6,722,443 B1 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,758,278 B2 7/2004 Cook et al.
6,796,380 B2 9/2004 Xu
6,814,147 B2 11/2004 Baugh
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,892,819 B2 5/2005 Cook et al.
6,902,000 B2 6/2005 Simpson et al.
6,902,652 B2 6/2005 Heijnen
2001/0045284 A1 11/2001 Simpson et al.
2001/0045289 A1 11/2001 Cook et al.
2002/0020524 A1 2/2002 Gano
2002/0020531 A1 2/2002 Ohmer
2002/0033261 A1 3/2002 Metcalfe
2002/0060068 A1 5/2002 Cook et al.
2003/0024708 A1 2/2003 Ring et al.
2003/0042022 A1 3/2003 Lauritzen et al.
2003/0067166 A1 4/2003 Maguire
2003/0168222 A1 9/2003 Maguire et al.
2003/0173090 A1 9/2003 Cook et al.
2003/0192705 A1 10/2003 Cook et al.
2003/0222455 A1 12/2003 Cook et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1* 4/2004 Cook et al. ..... 166/380
2004/0112606 A1 6/2004 Lewis et al.
2004/0129431 A1 7/2004 Jackson
2004/0159446 A1 8/2004 Haugen et al.
2004/0188099 A1 9/2004 Cook et al.
2004/0216873 A1 11/2004 Frost et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.

| | | | |
|---|---|---|---|
| 2004/0251034 | A1* | 12/2004 | Kendziora et al. ..... 166/384 |
| 2004/0262014 | A1 | 12/2004 | Cook et al. |
| 2005/0011641 | A1 | 1/2005 | Cook et al. |
| 2005/0015963 | A1 | 1/2005 | Costa et al. |
| 2005/0028988 | A1 | 2/2005 | Cook et al. |
| 2005/0039910 | A1 | 2/2005 | Lohbeck |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0045342 | A1 | 3/2005 | Luke et al. |
| 2005/0056433 | A1 | 3/2005 | Watson et al. |
| 2005/0056434 | A1 | 3/2005 | Ring et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |
| 2005/0098323 | A1 | 5/2005 | Cook et al. |
| 2005/0103502 | A1 | 5/2005 | Watson et al. |
| 2005/0123639 | A1 | 6/2005 | Ring et al. |
| 2005/0133225 | A1 | 6/2005 | Oosterling |
| 2005/0136790 | A1 | 6/2005 | Cook et al. |
| 2005/0144771 | A1 | 7/2005 | Cook et al. |
| 2005/0144772 | A1 | 7/2005 | Cook et al. |
| 2005/0144777 | A1 | 7/2005 | Cook et al. |
| 2005/0150098 | A1 | 7/2005 | Cook et al. |
| 2005/0150660 | A1 | 7/2005 | Cook et al. |
| 2005/0161228 | A1 | 7/2005 | Cook et al. |
| 2005/0166387 | A1 | 8/2005 | Cook et al. |
| 2005/0166388 | A1 | 8/2005 | Cook et al. |
| 2005/0173108 | A1 | 8/2005 | Cook et al. |
| 2005/0175473 | A1 | 8/2005 | Cook et al. |
| 2005/0183863 | A1 | 8/2005 | Cook et al. |
| 2005/0205253 | A1 | 9/2005 | Cook et al. |
| 2005/0217866 | A1 | 10/2005 | Watson et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| AU | 776580 | | 1/2005 |
| CA | 736288 | | 6/1966 |
| CA | 771462 | | 11/1967 |
| CA | 1171310 | | 7/1984 |
| CA | 2292171 | | 6/2000 |
| CA | 2298139 | | 8/2000 |
| CA | 2234386 | | 3/2003 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | WO02/40825 | A1 | 5/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |

| | | | |
|---|---|---|---|
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2412681 | A | 10/2005 |
| GB | 2412682 | A | 10/2005 |
| JP | 208458 | | 10/1985 |

| | | | |
|---|---|---|---|
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| SU | 1324722 | A1 | 2/1995 |

| | | | |
|---|---|---|---|
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO03/25800 | | 12/1993 |
| WO | WO93/25799 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |

| | | | |
|---|---|---|---|
| WO | WO02/095181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/106130 | A2 | 12/2003 |
| WO | WO04/003337 | A1 | 1/2004 |
| WO | WO04/009950 | A1 | 1/2004 |
| WO | WO04/010039 | A2 | 1/2004 |
| WO | WO04/010039 | A3 | 1/2004 |
| WO | WO04/011776 | A2 | 2/2004 |
| WO | WO04/011776 | A3 | 2/2004 |
| WO | WO04/018823 | A2 | 3/2004 |
| WO | WO04/018823 | A3 | 3/2004 |
| WO | WO04/018824 | A2 | 3/2004 |
| WO | WO04/018824 | A3 | 3/2004 |
| WO | WO04/020895 | A2 | 3/2004 |
| WO | WO04/020895 | A3 | 3/2004 |
| WO | WO04/023014 | A2 | 3/2004 |
| WO | WO04/023014 | A3 | 3/2004 |
| WO | WO04/026017 | A2 | 4/2004 |
| WO | WO04/026017 | A3 | 4/2004 |
| WO | WO04/026073 | A2 | 4/2004 |
| WO | WO04/026073 | A3 | 4/2004 |
| WO | WO04/026500 | A2 | 4/2004 |
| WO | WO04/026500 | A3 | 4/2004 |
| WO | WO04/027200 | A2 | 4/2004 |
| WO | WO04/027200 | A3 | 4/2004 |
| WO | WO04/027204 | A2 | 4/2004 |
| WO | WO04/027204 | A3 | 4/2004 |
| WO | WO04/027205 | A2 | 4/2004 |
| WO | WO04/027205 | A3 | 4/2004 |
| WO | WO04/027392 | A1 | 4/2004 |
| WO | WO04/027786 | A2 | 4/2004 |
| WO | WO04/027786 | A3 | 4/2004 |
| WO | WO04/053434 | A2 | 6/2004 |
| WO | WO04/053434 | A3 | 6/2004 |
| WO | WO04/057715 | A2 | 7/2004 |
| WO | WO04/057715 | A3 | 7/2004 |
| WO | WO04/067961 | A2 | 8/2004 |
| WO | WO04/067961 | A3 | 8/2004 |
| WO | WO04/072436 | A1 | 8/2004 |
| WO | WO04/074622 | A2 | 9/2004 |
| WO | WO04/074622 | A3 | 9/2004 |
| WO | WO04/076798 | A2 | 9/2004 |
| WO | WO04/076798 | A3 | 9/2004 |
| WO | WO04/081346 | A2 | 9/2004 |
| WO | WO04/083591 | A2 | 9/2004 |
| WO | WO04/083591 | A3 | 9/2004 |
| WO | WO04/083592 | A2 | 9/2004 |
| WO | WO04/083592 | A3 | 9/2004 |
| WO | WO04/083593 | A2 | 9/2004 |
| WO | WO04/083594 | A2 | 9/2004 |
| WO | WO04/083594 | A3 | 9/2004 |
| WO | WO04/085790 | A2 | 10/2004 |
| WO | WO04/089608 | A2 | 10/2004 |
| WO | WO04/092527 | A3 | 10/2004 |
| WO | WO04/092528 | A2 | 10/2004 |
| WO | WO04/092530 | A2 | 10/2004 |
| WO | WO04/092530 | A3 | 10/2004 |
| WO | WO04/094766 | A2 | 11/2004 |
| WO | WO05/017303 | A2 | 2/2005 |
| WO | WO05/021921 | A2 | 3/2005 |
| WO | WO05/021921 | A3 | 3/2005 |
| WO | WO05/021922 | A2 | 3/2005 |
| WO | WO05/021922 | A3 | 3/2005 |
| WO | WO05/024170 | A2 | 3/2005 |
| WO | WO05/024171 | A2 | 3/2005 |
| WO | WO05/028803 | A2 | 3/2005 |
| WO | WO05/071212 | A1 | 4/2005 |
| WO | WO05/081803 | A2 | 9/2005 |
| WO | WO05/086614 | A2 | 9/2005 |

OTHER PUBLICATIONS

Offshore, "Agbada Well Solid Tubulars Expanded Bottom Up, Screens Top Down" William Furlow, Jan. 2002.(copy not available).

Drilling Contractor, "Solid Expandable Tubulars are Enabling Technology" Mar./Apr. 2001 .(copy not available).

Hart's E & P, "SET Technology: Setting the Standard" Mar. 2002.

Hart's E & P, "An Expanded Horizon" Jim Brock, Lev Ring, Scott Costa, Andrei Filippov. Feb. 2000.

Hart's E & P, "Technology Strategy Breeds Value" Ali Daneshy. May 2004.

Hart's E & P, "Solid Expandable Tubulars Slimwell: Stepping Stone to MonoDiameter" Jun. 2003.

Innovators Chart the Course, Shelf Exploration & Production.

"Case Study: Value in Drilling Derived From Application-Specific Technology" Langley, Diane., Oct. 2004.

L'Usine Nouvelle, "Les Tubes Expansibles Chantent La Face Du Forage Petrolier" Demoulin, Laurence, No. 2878 , pp. 50-52, Jul. 3, 2003.

Offshore, "Monodiameter Technology Keeps Hole Diameter to TD", Hull, Jennifer., Oct. 2002.

News Release, "Shell and Halliburton Agree to Form Company to Develop and Market Expandable Casing Technology", 1998.

Offshore, "Expandable Tubulars Enable Multilaterals Without Compromise on Hole Size," DeMong, Karl, et al., Jun. 2003.

Offshore Engineer, "From Exotic to Routine- the offshore quick-step" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultra-deepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helps Operator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy, Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Growth Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Well in South Texas" Sumrow, Mike., Oct. 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Properties", Mack, R.D., et al., Jul. 1999, pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Linear—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technology" Patin, Michael, et al., 2003.
Offshore Technology Conference, "Expandable Cased-hole Liner Remediates Profilic Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemens Gertjan, et al., 2003.
"Practices for Providing Zonal Isolation in Conjunction with Expandable Casing Jobs-Case Histories" Sanders, T, et al. 2003.
Society of Petroleum Engineers, "Incresing Solid Expandable Tubular Technology Reliability in a Myriad of Downhole Enviroments", Escobar, C. et al., 2003.
Society of Petroleum Engineers, "Water Production Management—PDO's Successful Application of Expandable Technology", Braas, JCM, et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Envriron-ment", Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Cham, et al., 2000.
AADE Houston Chapter, "Subsidence Remediation—Extending Well Life Through the use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners- Summary of Case Histories" Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories- Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al., 1999.
Offshore Technology Conference, "Field Trial Proves Upgraes to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.
Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: The Value of Planned Installation vs. Contingency" Rivenbark, Mark, et al., 2004.

Society of Petroleum Engineers, "Changing Safety Paradigms in the Oil and Gas Industry" Ratliff, Matt, et al., 2004.
"Casing Remediation- Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: The Value of Planned Installations vs. Contingency", Carstens, Chris, et al.
Data Sheet, "Enventure Cased-Hole Liner (CHL) System" Enventure Global Technology, Dec. 2002.
Case History, "Graham Ranch No. 1 Newark East Barnett Field" Envenrture Global Technology, Feb. 2002.
Case History, "K.K. Camel No. 1 Ridge Field Lafayette Parish, Louisiana" Enventure Global Technology, Feb. 2002.
Case History, "Eemskanaal-2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
"Expand Your Opportunities." *Enventure*. CD-ROM. Jun. 1999.
"Expand Your Opportunities." *Enventure*. CD-ROM. May 2001.
International Examination Report, Application PCT/US02/25608; Jun. 1, 2005.
International Examination Report, Application PCT/US02/36267, Jan. 4, 2004.
International Examination Report, Application PCT/US02/39418, Feb. 18, 2005.
International Examination Report, Application PCT/US03/04837, Dec. 9, 2004.
International Examination Report, Application PCT/US03/06544, May 10, 2005.
International Examination Report, Application PCT/US03/11765; Dec. 10, 2004.
International Examination Report, Application PCT/US03/117655;; Jan 25, 2005.
International Examination Report, Application PCT/US03/13787; Apr. 7, 2005.
International Examination Report, Application PCT/US03/13787; Mar. 2, 2005.
International Examination Report, Application PCT/US03/14153; May 12, 2005.
International Examination Report, Application PCT/US03/15020; May 9, 2005.
International Examination Report, Application PCT/US03/25667, May 25, 2005.
International Search Report, Application PCT/US03/25716; Jan. 13, 2005.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Examination Report, Application PCT/US03/29858; May 23, 2005.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 15, 2005.
Examination Report to Application No. GB 0225505.7 Feb. 15, 2005.
Examination Report to Application No. GB 0314846.7, Jul. 15, 2004.
Search and Examination Report to Application No. GB 0400018.8; May 17, 2005.
Examination Report to Application No. GB 0400019.6; May 19, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. Gb 0404796.5; Apr. 14, 2005.
Examination Report to Application No. GB 0406257.6, Jan. 25, 2005.
Examination Report to Application No. GB 0406258.4; Jan. 12, 2005.
Examination Report to Application No. GB 0408672.4 Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Search Report to Application No. GB 0415835.8, Dec. 2, 2004.
Search Report to Application No. GB 0415835.8; Mar. 10, 2005.
Examination Report to Application No. 0416625.2 Jan. 20, 2005.
Search and Examination Report to Application No. GB 0416834.0, Nov. 16, 2004.
Examination Report to Application No. GB 0422419.2 Dec. 8, 2004.
Search and Examination Report to Application No. GB 0422893.8 Nov. 24, 2004.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. 0500600.2 Feb. 15, 2005.

Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Written Opinion to Application No. PCT/US02/25608 Feb. 2, 2005.
Written Opinion to Application No. PCT/US02/39425; Apr. 11, 2005.
Written Opinion to Application No. PCT/US03/06544; Feb. 18, 2005.
Written Opinion to Application No. PCT/US03/25675 May 9, 2005.
Written Opinion to Application No. PCT/US03/29858 Jan. 21, 2004.
Written Opinion to Application No. PCT/US03/38550 Dec. 10, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
International Examination Report, Application PCT/US02/24399, Aug. 6, 2004.
Examination Report, Application PCT/US02/25727; Jul. 7, 2004.
Examination Report, Application PCT/US03/10144; Jul. 7, 2004.
International Search Report, Application PCT/US03/20870; Sep. 30, 2004.
International Search Report, Application PCT/US03/25676; Aug. 17, 2004.
International Search Report, Application PCT/US03/25677, Aug. 17, 2004.
Examination Report to Application GB 0220872.6 Oct. 29, 2004.
Examination Report to Application No. GB 0225505.7, Oct. 27, 2004.
Examination Report to Application No. GB 0306046.4 Sep. 10, 2004.
Examination Report to Application No. GB 0314846.7, Jul. 15, 2004.
Examination Report to Application No. GB 0400018.8; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0404830.2, Aug. 17, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search and Examination Report to Application No. GB 0416834.0, Aug. 11, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US02/25727; May 17, 2004.
Written Opinion to Application No. PCT/US03/11765 May 11, 2004.
Written Opinion to Application No. PCT/US03/13787 Nov.9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including." (2004).
www.tribtech.com. "Trib-gel A Chemical Cold Weldng Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Peformance of Mechanical Seals by Laser Surface Texturing" Izhak Etsion.
Tribiology Transactions "Experimental Investigation of Laser Surface Texturing for Reciprocating Automative Components" G Ryk, Y Klingerman and I Etsion (2002).
Proceeding of the International Tribiology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).

Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Search Report, Application PCT/US03/11765; Nov. 13, 2003.
International Search Report, Application PCT/US03/13787; May 28, 2004.
International Search Report, Application PCT/US03/14153; May 28, 2004.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Search Report, Application PCT/US03/38550; Jun. 15, 2004.
Search and Examination Report to Application No. GB 0004282.0, Jun. 3, 2003.
Search Report to Application No. GB 0004285.3, Jan. 19, 2001.
Examination Report to Application No. GB 005399.1; Jul. 24, 2000.
Examination Report to Application No. GB 005399.1; Oct. 14, 2002.
Examination Report to Application No. GB0013661.4, Nov. 25, 2003.
Search Report to Application No. GB 0013661.4, Oct. 20, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0216409.3, Feb. 9, 2004.
Examination Report to Application No. GB 0219757.2, May 10. 2004.
Examination Report to Application No. GB 0300085.8, Nov. 28, 2003.
Examination Report to Application No. GB 030086.6, Dec. 1, 2003.
Examination Report to Application No. GB 0314846.7, Jul. 15, 2004.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Application No. GB 0308303.7, Jul. 14, 2003.
Examination Report to Application No. GB 0311596.1, May 18, 2004.
Search and Examination Report to Application No. GB 0313406.1, Sep. 3, 2003.
Search and Examination Report to Application No. GB 0313406.1, Sep. 3, 2003.
Search and Examination Report to Application No. GB 0316883.8, Nov. 25, 2003.
Search and Examination Report to Application No. GB 0316886.1, Nov. 25, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.

Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Examination Report to Application No. GB 04048377.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Examination Report to Application No. GB 0408672.4, Jul. 12, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search Report to Application No. GB 9926449.1, Jul. 4, 2001.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25727; May 17, 2004.
Written Opinion to Application No. PCT/US02/39418; Jun. 9, 2004.
Written Opinion to Application No. PCT/US003/11765 May 11, 2004.
Halliburton Energy Services, "Halliburton Completion Products" 1996, Page Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gitmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jul. 12, 2000.
Search Report to Application No. GB 0003251.6, Jul. 13, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.
Search Report to Application No. GB 9926449.1, Sep. 5, 2001.
Search Report to Application No. 1999 5593, Aug. 20, 2002.
Search Report to Application No. GB 0004285.3, Aug. 28, 2002.
Examination Report to Application No. GB 9926450.9, Nov. 22, 2002.
Search Report to Application No. GB 0219757.2, Nov. 25, 2002.

Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6, Mar. 13, 2003.
Examination Report to Application No. 0004285.3, Mar. 28, 2003.
Examination Report to Application No. GB 0208367.3, Apr. 4, 2003.
Examination Report to Application No. GB 0212443.6, Apr. 10, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308295.5, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/20870, Sep. 30, 2004.
International Preliminary Examination Report, Application PCT/US03/25675, Aug. 30, 2005.
International Preliminary Examination Report, Application PCT/US03/25742, Dec. 20, 2004.
International Preliminary Examination Report, Application PCT/US03/38550, May 23, 2005.
International Preliminary Report on Patentability, Application PCT/US04/08171, Sep. 13, 2005.
International Preliminary Report on Patentability, Application PCT/US04/28438, Sep. 20, 2005.
Combined Search Report and Written Opinion to Application No. PCT/US04/11973, Sep. 27, 2005.
Combined Search Report and Written Opinion to Application No. PCT/US04/28423, Jul. 13, 2005.
Search Report to Application No. GB 0415835.8, Dec. 2, 2004.
Search Report to Application No. GB 0415835.8, Mar. 10, 2005.
Examination Report to Application No. GB 0316883.8, Nov. 25, 2003.
Examination Report to Application No. GB 0316886.1, Nov. 25, 2003.
Examination Report to Application No. GB 0316887.9, Nov. 25, 2003.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0408672.4, Mar. 21, 2005.
Examination Report to Application No. GB 0411698.4, Jan. 24, 2005.
Examination Report to Application No. GB 0412533.2, May 20, 2005.
Examination Report to Application No. GB 0416834.0, Nov. 16, 2004.
Examination Report to Application No. GB 0500184.7, Sep. 12, 2005.
Examination Report to Application No. GB 0500600.2, Sep. 6, 2005.
Examination Report to Application No. GB 0507979.3, Jun. 16, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search Report to Application No. Norway 1999 5593, Aug. 20, 2002.

Arbuckle, "Advanced Laser Texturing Tames Tough Tasks," Metal Forming Magazine.
Brizmer et al., "A Laser Surface Textured Parallel Thrust Bearing," *Tribology Transactions*, 46(3):397-403, 2003.
Duphorne, "Letter Re: Enventure Claims of Baker Infringement of Enventure's Expandable Patents", Apr. 1, 2005.
Egge, "Technical Overview Production Enhancement Technology," Baker Hughes, Mar. 10, 2003.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
Etsion, "Improving Tribological Performance of Mechanical Seals by Laser Surface Texturing," *Surface Technologies*, LTD.
Etsion, "A Laser Surface Textured Hydrostatic Mechanical Seal," *Sealing Technology*, Mar. 2003.
"Expandable Sand Screens," *Weatherford Completion Systems*, 2002.
Fontova, "Solid Expandable Tubulars (SET) Provide Value to Operators Worldwide in a Variety of Applications," *EP Journal of Technology*, Apr. 2005.
Fraunhofer IWU, "Research Area: Sheet Metal Forming—Superposition of Vibrations," 2001.
Glimer et al., "World's First Completion Set Inside Expandable Screen," *High-Tech Wells*, 2003.
Guichelaar et al., "Effect of Micro-Surface Texturing on Breakaway Torque and Bister Formation on Carbon-Graphite Faces in a Mechanical Seal," *Lubrication Engineering*, Aug. 2002.
Haefke et al., "Microtexturing of Functional Surfaces for Improving Their Tribological Performance," *Proceedings of the International Tribology Conference*, 2000.
Halliburton Completion Products, 1996.
Linzell, "Trib-Gel A Chemical Cold Welding Agent," 1999.
Lizotte, "Scratching The Surface," *PT Design*, Jun. 19993.
Power Ultrasonics, "Design and Optimisation of An Ultrasonic Die System For Forming Metal Cans", 1999.
Ratliff, "Changing Safety Paradigms in the Oil and Gas Industry", *Society of Petroleum Engineers*, SPE 90828, 2004.
Ronen et al., "Friction-Reducing Surface-Texturing in Reciprocating Automotive Components," *Tribology Transactions*, 44(3):359-366, 2001.
Rky et al., "Experimental Investigation of Laser Surface Texturing for Reciprocating Automotive Components," *Tribology Transactions*, 45(4):444-449, 2002.
Turcotte et al., "Geodynamics Applications to Continuum Physics to Geological Problems," 1982.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
www.JETLUBE.com, "Oilfield Catalog—Jet-Lok Product Applicatin Descriptions," 1998.
www.MATERIALSRESOURCES.com, "Low Temperature Bonding of Dissimilar and Hard-to-Bond Materials and Metals Including," 2004.
www.MITCHMET.com, "3d Surface Texture Parameters," 2004.
www.SPURIND.com, "Glavanic Protection, Metallurgical Bonds, Custom Fabrications -Spur Industries," 2000.

* cited by examiner

MONO-DIAMETER WELLBORE CASING

CROSS REFERENCE TO RELATED APPLICATIONS

This application is the U.S. national stage utility patent application corresponding to PCT patent application Ser. No. PCT/US02/00677, filed on Jan. 11, 2002, having a priority date of Jan. 17, 2001, and claims the benefit of the filing date of U.S. provisional patent application Ser. No. 60/262,434, filed on Jan. 17, 2001, the disclosures of which are incorporated herein by reference.

This application is also a continuation-in-part of U.S. utility application Ser. No. 10/418,687, filed on Apr. 18, 2003, now U.S. Pat. No. 7,021,390 which issued Apr. 4, 2006 which was a continuation of U.S. utility application Ser. No. 09/852,026, filed on May 9, 2001, which issued as U.S. Pat. No. 6,561,227, which was a continuation of U.S. utility application Ser. No. 09/454,139, filed on Dec. 3, 1999, which issued as U.S. Pat. No. 6,497,289, which claimed the benefit of the filing date of U.S. provisional patent application Ser. No. 60/111,293, filed on Dec. 7, 1998, the disclosures of which are incorporated herein by reference.

This application is related to the following: (1) U.S. patent application Ser. No. 09/454,139, filed on Dec. 3, 1999, now U.S. Pat. No. 6,497,289; (2) U.S. patent application Ser. No. 09/510,913, filed on Feb. 23, 2000, (3) U.S. patent application Ser. No. 09/502,350, filed on Feb. 10, 2000, now U.S. Pat. No. 6,823,937; (4) U.S. patent application Ser. No. 09/440,338, filed on Nov. 15, 1999, now U.S. Pat. No. 6,328,113; (5) U.S. patent application Ser. No. 09/523,460, filed on Mar. 10, 2000, now U.S. Pat. No. 6,640,903; (6) U.S. patent application Ser. No. 09/512,895, filed on Feb. 24, 2000, now U.S. Pat. No. 6,568,471; (7) U.S. patent application Ser. No. 09/511,941, filed on Feb. 24, 2000, now U.S. Pat. No. 6,575,240; (8) U.S. patent application Ser. No. 09/588,946, filed on Jun. 7, 2000, now U.S. Pat. No. 6,557,640; (9) U.S. patent application Ser. No. 09/559,122, filed on Apr. 26, 2000, now U.S. Pat. No. 6,604,763; (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. Pat. No. 6,564,875, which was filed as application Ser. No. 09/679,907, on Oct. 5, 2000, which claims priority from U.S. provisional patent application Ser. No. 60/159,082, filed on Oct. 12, 1999, (14) U.S. patent application Ser. No. 10/089,419, filed on Mar. 27, 2002, now U.S. Pat. No. 6,695,012 which issued Feb. 24, 2004, which claims priority from U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, now U.S. Pat. No. 6,976,541; (21) U.S. provisional patent application Ser. No. 60/237,334, filed on Oct. 2, 2000, and (22) U.S. provisional patent application Ser. No. 60/259,486, filed on Jan. 3, 2001, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. patent No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, now U.S. Pat. No. 6,695,012 which issued Feb. 24, 2004, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, now U.S. Pat. No. 6,976,541 which issued Dec. 20, 2005, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, now U.S. Pat. No. 6,892,819 which issued May 17, 2005, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, now U.S. Pat. No. 6,739,392 which issued May 25, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, now U.S. Pat. No. 6,725,919 which issued Apr. 27, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, now U.S. Pat. No. 6,758,278 which issued Jul. 6, 2004, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, now U.S. Pat. No. 6,745,845 which issued Jun. 8, 2004, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, now U.S. Pat. No. 6,705,395 which issued Mar. 16, 2004, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, now U.S. Pat. No. 6,631,759 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, now U.S. Pat. No. 6,631,769 which issued Oct. 14, 2003, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, now U.S. Pat. No. 7,063,142 which issued Jun. 20, 2006, which is a divisional of U.S. Pat. No. 6,568,471, which was filed as patent application Ser. No. 09/512,895, filed on Feb. 24, 2000, which claims priority from provisional application 60/121, 841, filed on Feb. 26, 1999, (54) U.S. patent application Ser. No. 10/078,928, filed on Feb. 20, 2002, now U.S. Pat. No. 6,684,947 which issued Feb. 3, 2004, which is a divisional of U.S. Pat. No. 6,568,471, which was filed as patent application Ser. No. 09/512,895, filed on Feb. 24, 2000, which claims priority from provisional application 60/121, 841, filed on Feb. 26, 1999, (55) U.S. patent application Ser. No. 10/078,922, filed on Feb. 20, 2002, now U.S. Pat. No. 6,966,370 which issued Nov. 22, 2005, which is a divisional of U.S. Pat. No. 6,568,471, which was filed as patent application Ser. No. 09/512,895, filed on Feb. 24, 2000, which claims priority from provisional application 60/121, 841, filed on Feb. 26, 1999, (56) U.S. patent application Ser. No. 10/078,921, filed on Feb. 20, 2002, now U.S. Pat. No. 7,044,221 which issued May 16, 2006, which is a divisional of U.S. Pat. No. 6,568,471, which was filed as patent application Ser. No. 09/512,895, filed on Feb. 24, 2000, which claims priority from provisional application 60/121, 841, filed on Feb. 26, 1999, (57) U.S. patent application Ser. No. 10/261,928, filed on Oct. 1, 2002, now U.S. Pat. No. 7,011,161 which issued Mar. 14, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, now U.S. Pat. No. 7,040,396 which issued May 9, 2006, which is a divisional of U.S. Pat. No. 6,568,471, which was filed as patent application Ser. No. 09/512,895, filed on Feb. 24, 2000, which claims priority from provisional application 60/121, 841, filed on Feb. 26, 1999, (59) U.S. patent application Ser. No. 10/262,009, filed on Oct. 1, 2002, now U.S. Pat. No. 7,048,062 which issued May 23, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, now U.S. Pat. No. 6,857,473 which issued Feb. 22, 2005, which is a divisional of U.S. Pat. No. 6,568,471, which was filed as patent application Ser. No. 09/512,895, filed on Feb. 24, 2000, which claims priority from provisional application 60/121, 841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346, 309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, now U.S. Pat. No. 7,077,213 which issued Jul. 18, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, now U.S. Pat. No. 7,036,582 which issued May 2, 2006, which is a divisional of U.S. Pat. No. 6,557,640, which was filed as patent application Ser. No. 09/588,946, filed on Jun. 7, 2000, which claims priority from provisional application 60/137, 998, filed on Jun. 7, 1999, (72) U.S. patent application Ser. No. 10/261,925, filed on Oct. 1, 2002, now U.S. Pat. No. 7,044,218 which issued May 16, 2006, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111, 293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397, 284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCI application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6.497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423.363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, now U.S. Pat. No. 6,823,937 which issued Nov. 30, 2004, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. patent application Ser. No. 10/418,687, filed on Apr. 18, 2003, now U.S. Pat. No. 7,021,390 which issued Apr. 4, 2006, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, now U.S. Pat. No. 6,968,618 which issued Nov. 29, 2005, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, now U.S. Pat. No. 7,055,608 which issued Jun. 6, 2006, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application Ser. No. PCT/US2004/06246, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT/US2004/08073, filed on Mar. 18, 2004; (126) PCT patent application Ser. No. PCT/US2004/07711, filed on Mar. 11, 2004; (127) PCT patent application Ser. No. PCT/US2004/029025, filed on Mar. 26, 2004; (128) PCT patent application Ser. No. PCT/US2004/010317, filed on Apr. 2, 2004; (129) PCT patent application Ser. No. PCT/US2004/010712, filed on Apr. 6, 2004; (130) PCT patent application Ser. No. PCT/US2004/010762, filed on Apr. 6, 2004; (131) PCT patent application Ser. No. PCT/US2004/011973, filed on Apr. 15, 2004; (132) U.S. provisional patent application Ser. No. 60/495056, filed on Aug. 14, 2003; (133) U.S. provisional patent application Ser. No. 60/600679, filed on Aug. 11, 2004; (134) PCT patent application Ser. No. PCT/US2005/027318, filed on Jul. 29, 2005; (135) PCT patent application Ser. No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser. No. PCT/US2005/028641, filed on Aug. 11, 2005; (139) PCT patent application Ser. No. PCT/US2005/028819, filed on Aug. 11, 2005; (140) PCT patent application Ser. No. PCT/US2005/028446, filed on Aug. 11, 2005; (141) PCT patent application Ser. No. PCT/US2005/028642, filed on Aug. 11, 2005; (142) PCT patent application Ser. No. PCT/US2005/028451, filed on Aug. 11, 2005, and (143). PCT patent application Ser. No. PCT/US2005/028473, filed on Aug. 11, 2005, (144) U.S. utility patent application Ser. No. 10/546082, filed on Aug. 16, 2005, (145) U.S. utility patent application Ser. No. 10/546076, filed on Aug. 16, 2005, (146) U.S. utility patent application Ser. No. 10/545936, filed on Aug. 16, 2005, (147) U.S. utility patent application Ser. No. 10/546079, filed on Aug. 16, 2005 (148) U.S. utility patent application Ser. No. 10/545941, filed on Aug. 16, 2005, (149) U.S. utility patent application Ser. No. 546078, filed on Aug. 16, 2005, filed on Aug. 11, 2005. (150) U.S. utility patent application Ser. No. 10/545941, filed on Aug. 16, 2005, (151) U.S. utility patent application Ser. No. 11/249967, filed on Oct. 13, 2005. (152) U.S. provisional patent application Ser. No. 60/734302, filed on Nov. 7, 2005, (153) U.S. provisional patent application Ser. No. 60/725,181, filed on Oct. 11, 2005, (154) PCT patent application Ser. No. PCT/US2005/023391, filed Jun. 29, 2005 which claims priority from U.S. provisional patent application Ser. No. 60/585370, filed on Jul. 2, 2004, (155) U.S. provisional patent application Ser. No. 60/721579, filed on Sep. 28, 2005, (156) U.S. provisional patent application Ser. No. 60/717391, filed on Sep. 15, 2005, (157) U.S. provisional patent application Ser. No. 60/702935, filed on Jul. 27, 2005, (158) U.S. provisional patent application Ser. No.

60/663913, filed on Mar. 21, 2005, (159) U.S. provisional patent application Ser. No. 60/652564, filed on Feb. 14, 2005, (160) U.S. provisional patent application Ser. No. 60/645840, filed on Jan. 21, 2005, (161) PCT patent application Ser. No. PCT/US2005/043122, filed on Nov. 29, 2005 which claims priority from U.S. provisional patent application Ser. No. 60/631703, filed on Nov. 30, 2004, (162) U.S. provisional patent application Ser. No. 60/752787, filed on Dec. 22, 2005, (163) U.S. National Stage application Ser. No. 10/548934, filed on Sep. 12, 2005; (164) U.S. National Stage application Ser. No. 10/549410, filed on Sep. 13, 2005; (165) U.S. Provisional patent application No. 60/717391, filed on Sep. 15, 2005; (166) U.S. National Stage application Ser. No. 10/550906, filed on Sep. 27, 2005; (167) U.S. National Stage application Ser. No. 10/551880, filed on Sep. 30, 2005; (168) U.S. National Stage application Ser. No. 10/552253, filed on Oct. 4, 2005; (169) U.S. National Stage application Ser. No. 10/552790, filed on Oct. 11, 2005; (170) U.S. Provisional patent application No. 60/725181, filed on Oct. 11, 2005; (171) U.S. National Stage application Ser. No. 10/553094, filed on Oct. 13, 2005; (172) U.S. National Stage application Ser. No. 10/553566, filed on Oct. 17, 2005; (173) PCT Patent Application No. PCT/US2006/002449, filed on Jan. 20, 2006, (174) PCT patent application No. PCT/US2006/004809, filed on Feb. 9, 2006; (175) U.S. Utility Patent application Ser. No. 11/356899, filed on Feb. 17, 2006, (176) U.S. National Stage application Ser. No. 10/568200, filed on Feb. 13, 2006, (177) U.S. National Stage application Ser. No. 10/568719, filed on Feb. 16, 2006, filed on Feb. 16, 2006, (178) U.S. National Stage application Ser. No. 10/569323, filed on Feb. 17, 2006, (179) U.S. National State patent application Ser. No. 10/571041, filed on Mar. 3, 2006; (180) U.S. National State patent application Ser. No. 10/571017, filed on Mar. 3, 2006; (181) U.S. National State patent application Ser. No. 10/571086, filed on Mar. 6, 2006; and (182) U.S. National State patent application Ser. No. 10/571085, filed on Mar. 6, 2006, (183) U.S. utility patent application Ser. No. 10/938788, filed on Sep. 10, 2004, (184) U.S. utility patent application Ser. No. 10/938225, filed on Sep. 10, 2004, (185) U.S. utility patent application Ser. No. 10/952288, filed on Sep. 28, 2004, (186) U.S. utility patent application Ser. No. 10/952416, filed on Sep. 28, 2004, (187) U.S. utility patent application Ser. No. 10/950749, filed on Sep. 27, 2004, (188) U.S. utility patent application Ser. No. 10/950869, filed on Sep. 27, 2004; (189) U.S. provisional patent application Ser. No. 60/761324, filed on Jan. 23, 2006, (190) U.S. provisional patent application Ser. No. 60/754556, filed on Dec. 28, 2005, (191) U.S. utility patent application Ser. No. 11/380051, filed on Apr. 25, 2006, (192) U.S. utility patent application Ser. No. 11/380055, filed on Apr. 25, 2006, (193) U.S. utility patent application Ser. No. 10/522039, filed on Mar. 10, 2006; (194) U.S. provisional patent application Ser. No. 60/746,813, filed on May 9, 2006; (195) U.S. utility patent application Ser. No. 11/456584, filed on Jul. 11, 2006; and (196) U.S. utility patent application Ser. No. 11/456587, filed on Jul. 11, 2006; (197) PCT Patent Application No. PCT/US2006/009886, filed on Mar. 21, 2006; (198) PCT patent application No. PCT/US2006/010674, filed on Mar. 21, 2006; (199) U.S. Pat. No. 6,409,175 which issued Jun. 25, 2002, (200) U.S. Pat. No. 6,550,821 which issued Apr. 22, 2003, (201) U.S. patent application Ser. No. 10/767,953, filed Jan. 29, 2004, now U.S. Pat. No. 7,077,211 which issued Jul. 18, 2006; (202) U.S. patent application Ser. No. 10/769,726, filed Jan. 30, 2004, (203) U.S. patent application Ser. No. 10/770,363 filed Feb. 2, 2004, (204) U.S. utility patent application Ser. No. 11/068,595, filed on Feb. 28, 2005; (205) U.S. utility patent application Ser. No. 11/070,147, filed on Mar. 2, 2005; (206) U.S. utility patent application Ser. No. 11/071,409, filed on Mar. 2, 2005; (207) U.S. utility patent application Ser. No. 11/071,557, filed on Mar. 3, 2005; (208) U.S. utility patent application Ser. No. 11/072,578, filed on Mar. 4, 2005; (209) U.S. utility patent application Ser. No. 11/072,893, filed on Mar. 4, 2005; (210) U.S. utility patent application Ser. No. 11/072,594, filed on Mar. 4, 2005; (211) U.S. utility patent application Ser. No. 11/074,366, filed on Mar. 7, 2005; and (212) U.S. utility patent application Ser. No. 11/074,266, filed on Mar. 7, 2005.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming new sections of casing in a wellbore.

SUMMARY OF THE INVENTION

According to one aspect of the present invention, a method of creating a mono-diameter wellbore casing in a borehole located in a subterranean formation including a preexisting wellbore casing is provided that includes installing a tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the preexisting wellbore casing and the tubular liner using a second expansion cone.

According to another aspect of the present invention, an apparatus for forming a mono-diameter wellbore casing in a borehole located in a subterranean formation including a preexisting wellbore casing is provided that includes means for installing a tubular liner and a first expansion cone in the borehole, means for injecting a fluidic material into the borehole, means for pressurizing a portion of an interior region of the tubular liner below the first expansion cone, means for radially expanding at least a portion of the tubular liner in the borehole by extruding at least a portion of the tubular liner off of the first expansion cone, and means for radially expanding at least a portion of the preexisting wellbore casing and the tubular liner using a second expansion cone.

According to another aspect of the present invention, a method of joining a second tubular member to a first tubular member positioned within a subterranean formation, the first tubular member having an inner diameter greater than an outer diameter of the second tubular member is provided that includes positioning a first expansion cone within an interior region of the second tubular member, pressurizing a portion of the interior region of the second tubular member adjacent to the first expansion cone, extruding at least a portion of the second tubular member off of the first expansion cone into engagement with the first tubular member, and radially expanding at least a portion of the first tubular member and the second tubular member using a second expansion cone.

According to another aspect of the present invention, an apparatus for joining a second tubular member to a first tubular member positioned within a subterranean formation, the first tubular member having an inner diameter greater than an outer diameter of the second tubular member, is provided that includes means for positioning a first expansion cone within an interior region of the second tubular member, means for pressurizing a portion of the interior region of the second tubular member adjacent to the first expansion cone, means for extruding at least a portion of the second tubular member off of the first expansion cone into engagement with the first tubular member, and means for radially expanding at least a portion of the first tubular member and the second tubular member using a second expansion cone.

According to another aspect of the present invention, an apparatus is provided that includes a subterranean formation including a borehole, a wellbore casing coupled to the borehole, and a tubular liner coupled to the wellbore casing. The inside diameters of the wellbore casing and the tubular liner are substantially equal, and the tubular liner is coupled to the wellbore casing by a method that includes installing the tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the wellbore casing and the tubular liner using a second expansion cone.

According to another aspect of the present invention, an apparatus is provided that includes a subterranean formation including a borehole, a first tubular member coupled to the borehole, and a second tubular member coupled to the wellbore casing. The inside diameters of the first and second tubular members are substantially equal, and the second tubular member is coupled to the first tubular member by a method that includes installing the second tubular member and a first expansion cone in the borehole, injecting a fluidic material into the borehole, pressurizing a portion of an interior region of the second tubular member below the first expansion cone, radially expanding at least a portion of the second tubular member in the borehole by extruding at least a portion of the second tubular member off of the first expansion cone, and radially expanding at least a portion of the first tubular member and the second tubular member using a second expansion cone.

According to another aspect of the present invention, an apparatus for radially expanding an overlapping joint between a wellbore casing and a tubular liner is provided that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

According to another aspect of the present invention, a method of radially expanding an overlapping joint between a wellbore casing and a tubular liner is provided that includes positioning an expansion cone within the wellbore casing above the overlapping joint, sealing off an annular region within the wellbore casing above the expansion cone, displacing the expansion cone by pressurizing the annular region, and removing fluidic materials displaced by the expansion cone from the tubular liner.

According to another aspect of the present invention, an apparatus for radially expanding an overlapping joint between a wellbore casing and a tubular liner is provided that includes means for positioning an expansion cone within the wellbore casing above the overlapping joint, means for sealing off an annular region within the wellbore casing above the expansion cone, means for displacing the expansion cone by pressurizing the annular region, and means for removing fluidic materials displaced by the expansion cone from the tubular liner.

According to another aspect of the present invention, an apparatus for radially expanding an overlapping joint between a wellbore casing and a tubular liner is provided that includes a tubular support including a first passage, a sealing member coupled to the tubular support, a releasable latching member coupled to the tubular support, and an expansion cone releasably coupled to the releasable latching member including a second passage fluidicly coupled to the first passage.

According to another aspect of the present invention, a method of radially expanding an overlapping joint between a wellbore casing and a tubular liner is provided that includes positioning an expansion cone within the wellbore casing above the overlapping joint, sealing off a region within the wellbore casing above the expansion cone, releasing the expansion cone, and displacing the expansion cone by pressurizing the annular region.

According to another aspect of the present invention, an apparatus for radially expanding an overlapping joint between a wellbore casing and a tubular liner is provided that includes means for positioning an expansion cone within the wellbore casing above the overlapping joint, means for sealing off a region within the wellbore casing above the expansion cone, means for releasing the expansion cone, and means for displacing the expansion cone by pressurizing the annular region.

According to another aspect of the present invention, an apparatus for radially expanding an overlapping joint between first and second tubular members is provided that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

According to another aspect of the present invention, a method of radially expanding an overlapping joint between first and second tubular members is provided that includes positioning an expansion cone within the first tubular member above the overlapping joint, sealing off an annular region within the first tubular member above the expansion cone, displacing the expansion cone by pressurizing the annular region, and removing fluidic materials displaced by the expansion cone from the second tubular member.

According to another aspect of the present invention, an apparatus for radially expanding an overlapping joint between first and second tubular members is provided that includes means for positioning an expansion cone within the first tubular member above the overlapping joint, means for sealing off an annular region within the first tubular member above the expansion cone, means for displacing the expansion cone by pressurizing the annular region, and means for removing fluidic materials displaced by the expansion cone from the second tubular member.

According to another aspect of the present invention, an apparatus for radially expanding an overlapping joint between first and second tubular members is provided that includes a tubular support including a first passage, a sealing member coupled to the tubular support, a releasable latching member coupled to the tubular support, and an expansion cone releasably coupled to the releasable latching member including a second passage fluidicly coupled to the first passage.

According to another aspect of the present invention, a method of radially expanding an overlapping joint between first and second tubular members is provided that includes positioning an expansion cone within the first tubular member above the overlapping joint, sealing off a region within the first tubular member above the expansion cone, releasing the expansion cone, and displacing the expansion cone by pressurizing the annular region.

According to another aspect of the present invention, an apparatus for radially expanding an overlapping joint between first and second tubular members is provided that includes means for positioning an expansion cone within the first tubular member above the overlapping joint, means for sealing off a region within the first tubular member above the expansion cone, means for releasing the expansion cone, and means for displacing the expansion cone by pressurizing the annular region.

DETAILED DESCRIPTION OF THE ILLUSTRATIVE EMBODIMENTS

Figure 1:
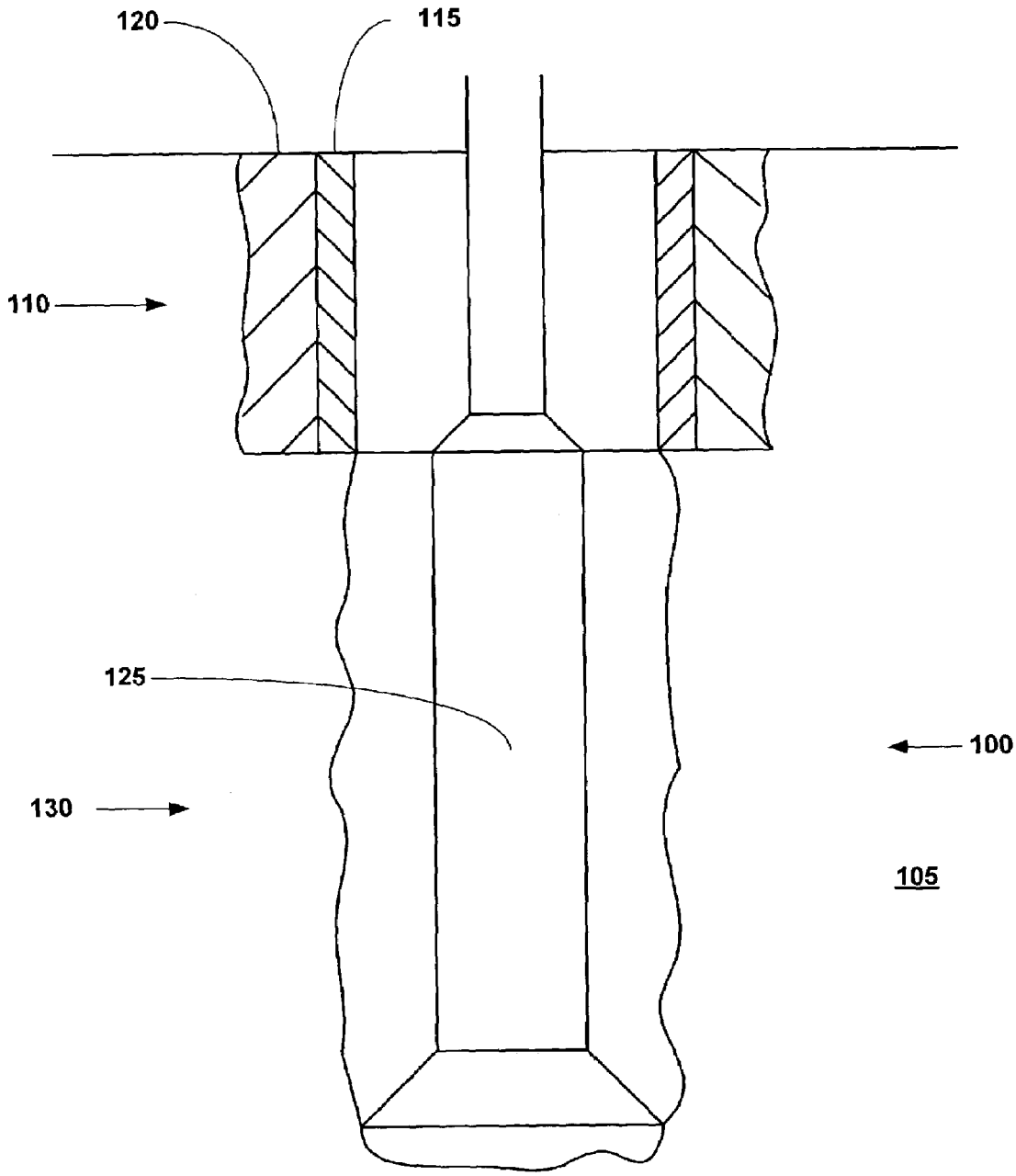
FIG. 1 is a fragmentary cross-sectional view illustrating the drilling of a new section of a well borehole.

Referring initially to FIGS. 1–9, an embodiment of an apparatus and method for forming a mono-diameter wellbore casing within a subterranean formation will now be described. As illustrated in FIG. 1, a wellbore 100 is positioned in a subterranean formation 105. The wellbore 100 includes a pre-existing cased section 110 having a tubular casing 115 and an annular outer layer 120 of a fluidic sealing material such as, for example, cement. The wellbore 100 may be positioned in any orientation from vertical to horizontal. In several alternative embodiments, the pre-existing cased section 110 does not include the annular outer layer 120.

In order to extend the wellbore 100 into the subterranean formation 105, a drill string 125 is used in a well known manner to drill out material from the subterranean formation 105 to form a new wellbore section 130.

Figure 2:
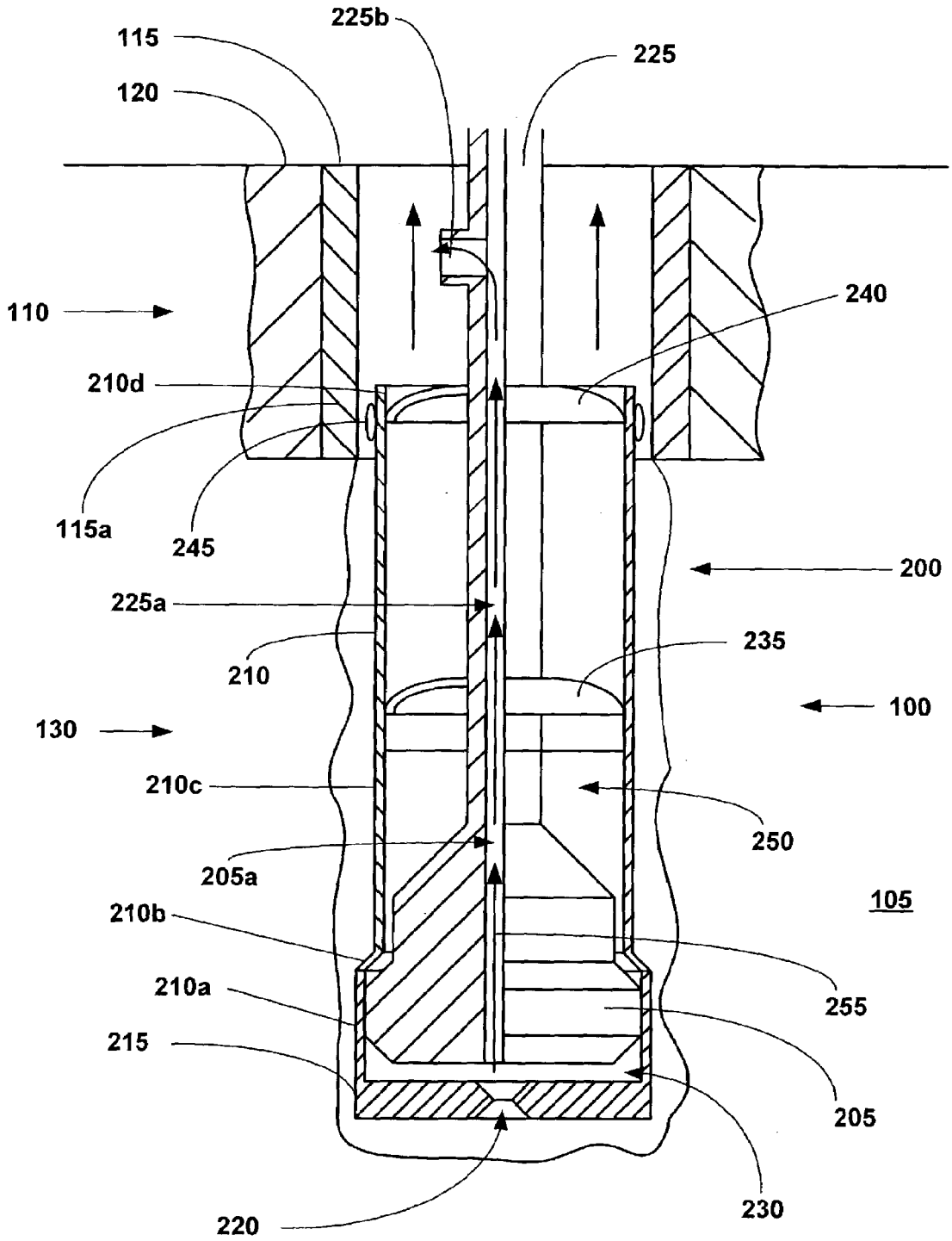
FIG. 2 is a fragmentary cross-sectional view illustrating the placement of an embodiment of an apparatus for creating a casing within the new section of the well borehole of FIG. 1.

As illustrated in FIG. 2, an apparatus 200 for forming a wellbore casing in a subterranean formation is then positioned in the new section 130 of the wellbore 100. The apparatus 200 preferably includes an expansion cone 205 having a fluid passage 205*a* that supports a tubular member 210 that includes a lower portion 210*a*, an intermediate portion 210*b*, an upper portion 210*c*, and an upper end portion 210*d*.

The expansion cone 205 may be any number of conventional commercially available expansion cones. In several alternative embodiments, the expansion cone 205 may be controllably expandable in the radial direction, for example, as disclosed in U.S. Pat. Nos. 5,348,095, and/or 6,012,523, the disclosures of which are incorporated herein by reference.

The tubular member 210 may be fabricated from any number of conventional commercially available materials such as, for example, Oilfield Country Tubular Goods (OCTG), 13 chromium steel tubing/casing, or plastic tubing/casing. In a preferred embodiment, the tubular member 210 is fabricated from OCTG in order to maximize strength after expansion. In several alternative embodiments, the tubular member 210 may be solid and/or slotted. In a preferred embodiment, the length of the tubular member 210 is limited to minimize the possibility of buckling. For typical tubular member 210 materials, the length of the tubular member 210 is preferably limited to between about 40 to 20,000 feet in length.

The lower portion 210*a* of the tubular member 210 preferably has a larger inside diameter than the upper portion 210*c* of the tubular member. In a preferred embodiment, the wall thickness of the intermediate portion 210*b* of the tubular member 201 is less than the wall thickness of the upper portion 210*c* of the tubular member in order to faciliate the initiation of the radial expansion process. In a preferred embodiment, the upper end portion 210*d* of the tubular member 210 is slotted, perforated, or otherwise modified to catch or slow down the expansion cone 205 when it completes the extrusion of tubular member 210.

A shoe 215 is coupled to the lower portion 210*a* of the tubular member. The shoe 215 includes a valveable fluid passage 220 that is preferably adapted to receive a plug, dart, or other similar element for controllably sealing the fluid passage 220. In this manner, the fluid passage 220 may be optimally sealed off by introducing a plug, dart and/or ball sealing elements into the fluid passage 240.

The shoe 215 may be any number of conventional commercially available shoes such as, for example, Super Seal II float shoe, Super Seal II Down-Jet float shoe or a guide shoe with a sealing sleeve for a latch down plug modified in accordance with the teachings of the present disclosure. In a preferred embodiment, the shoe 215 is an aluminum down-jet guide shoe with a sealing sleeve for a latch-down plug available from Halliburton Energy Services in Dallas, Tex., modified in accordance with the teachings of the present disclosure, in order to optimally guide the tubular member 210 in the wellbore, optimally provide an adequate seal between the interior and exterior diameters of the overlapping joint between the tubular members, and to optimally allow the complete drill out of the shoe and plug after the completion of the cementing and expansion operations.

In a preferred embodiment, the shoe 215 further includes one or more through and side outlet ports in fluidic communication with the fluid passage 220. In this manner, the shoe 215 optimally injects hardenable fluidic sealing material into the region outside the shoe 215 and tubular member 210.

A support member 225 having fluid passages 225*a* and 225*b* is coupled to the expansion cone 205 for supporting the apparatus 200. The fluid passage 225*a* is preferably fluidicly coupled to the fluid passage 205*a*. In this manner, fluidic materials may be conveyed to and from a region 230 below the expansion cone 205 and above the bottom of the shoe 215. The fluid passage 225*b* is preferably fluidicly coupled to the fluid passage 225*a* and includes a conventional control valve. In this manner, during placement of the apparatus 200 within the wellbore 100, surge pressures can be relieved by the fluid passage 225*b*. In a preferred embodiment, the support member 225 further includes one or more conventional centralizers (not illustrated) to help stabilize the apparatus 200.

During placement of the apparatus 200 within the wellbore 100, the fluid passage 225*a* is preferably selected to transport materials such as, for example, drilling mud or formation fluids at flow rates and pressures ranging from about 0 to 3,000 gallons/minute and 0 to 9,000 psi in order to minimize drag on the tubular member being run and to minimize surge pressures exerted on the wellbore 130 which could cause a loss of wellbore fluids and lead to hole collapse. During placement of the apparatus 200 within the wellbore 100, the fluid passage 225*b* is preferably selected to convey fluidic materials at flow rates and pressures ranging from about 0 to 3,000 gallons/minute and 0 to 9,000 psi in order to reduce the drag on the apparatus 200 during insertion into the new section 130 of the wellbore 100 and to minimize surge pressures on the new wellbore section 130.

A lower cup seal 235 is coupled to and supported by the support member 225. The lower cup seal 235 prevents foreign materials from entering the interior region of the tubular member 210 adjacent to the expansion cone 205. The lower cup seal 235 may be any number of conventional commercially available cup seals such as, for example, TP cups, or Selective Injection Packer (SIP) cups modified in accordance with the teachings of the present disclosure. In a preferred embodiment, the lower cup seal 235 is a SIP cup seal, available from Halliburton Energy Services in Dallas, Tex. in order to optimally block foreign material and contain a body of lubricant.

The upper cup seal 240 is coupled to and supported by the support member 225. The upper cup seal 240 prevents foreign materials from entering the interior region of the tubular member 210. The upper cup seal 240 may be any number of conventional commercially available cup seals such as, for example, TP cups or SIP cups modified in accordance with the teachings of the present disclosure. In a preferred embodiment, the upper cup seal 240 is a SIP cup, available from Halliburton Energy Services in Dallas, Tex. in order to optimally block the entry of foreign materials and contain a body of lubricant.

One or more sealing members 245 are coupled to and supported by the exterior surface of the upper end portion 210*d* of the tubular member 210. The seal members 245 preferably provide an overlapping joint between the lower end portion 115*a* of the casing 115 and the portion 260 of the tubular member 210 to be fluidicly sealed. The sealing members 245 may be any number of conventional commercially available seals such as, for example, lead, rubber, Teflon, or epoxy seals modified in accordance with the teachings of the present disclosure. In a preferred embodiment, the sealing members 245 are molded from Stratalock epoxy available from Halliburton Energy Services in Dallas, Tex. in order to optimally provide a load bearing interference fit between the upper end portion 210*d* of the tubular member 210 and the lower end portion 115*a* of the existing casing 115.

In a preferred embodiment, the sealing members 245 are selected to optimally provide a sufficient frictional force to support the expanded tubular member 210 from the existing casing 115. In a preferred embodiment, the frictional force optimally provided by the sealing members 245 ranges from about 1,000 to 1,000,000 lbf in order to optimally support the expanded tubular member 210.

In a preferred embodiment, a quantity of lubricant 250 is provided in the annular region above the expansion cone 205 within the interior of the tubular member 210. In this manner, the extrusion of the tubular member 210 off of the expansion cone 205 is facilitated. The lubricant 250 may be any number of conventional commercially available lubricants such as, for example, Lubriplate, chlorine based lubricants, oil based lubricants or Climax 1500 Antisieze (3100). In a preferred embodiment, the lubricant 250 is Climax 1500 Antisieze (3100) available from Climax Lubricants and Equipment Co. in Houston, Tex. in order to optimally provide optimum lubrication to faciliate the expansion process.

In a preferred embodiment, the support member 225 is thoroughly cleaned prior to assembly to the remaining portions of the apparatus 200. In this manner, the introduction of foreign material into the apparatus 200 is minimized. This minimizes the possibility of foreign material clogging the various flow passages and valves of the apparatus 200.

In a preferred embodiment, before or after positioning the apparatus 200 within the new section 130 of the wellbore 100, a couple of wellbore volumes are circulated in order to ensure that no foreign materials are located within the wellbore 100 that might clog up the various flow passages and valves of the apparatus 200 and to ensure that no foreign material interferes with the expansion process.

As illustrated in FIG. 2, in a preferred embodiment, during placement of the apparatus 200 within the wellbore 100, fluidic materials 255 within the wellbore that are displaced by the apparatus are conveyed through the fluid passages 220, 205*a*, 225*a*, and 225*b*. In this manner, surge pressures created by the placement of the apparatus within the wellbore 100 are reduced.

Figure 3:
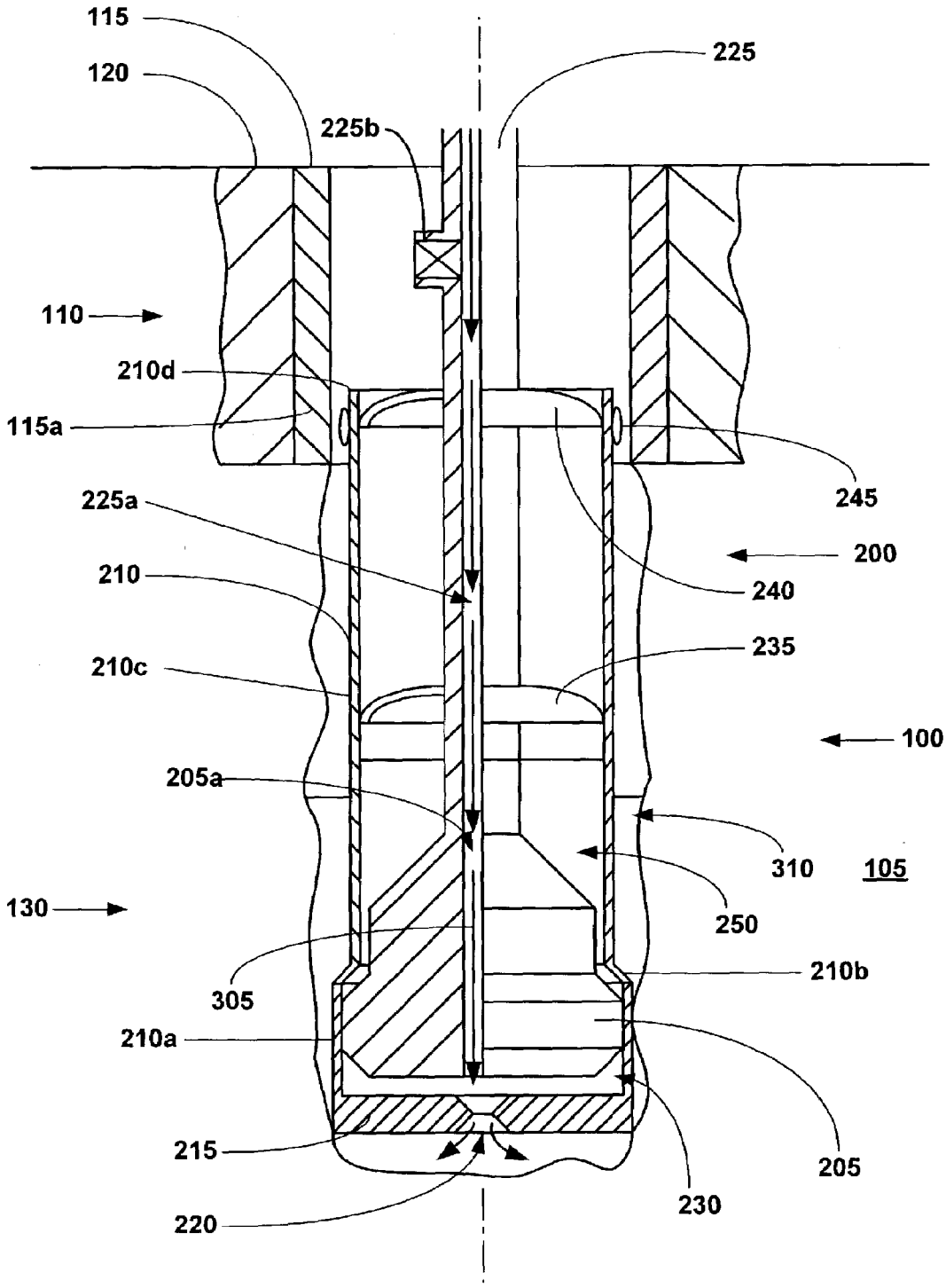
FIG. 3 is a fragmentary cross-sectional view illustrating the injection of a hardenable fluidic sealing material into the new section of the well borehole of FIG. 2.

As illustrated in FIG. 3, the fluid passage 225*b* is then closed and a hardenable fluidic sealing material 305 is then pumped from a surface location into the fluid passages 225*a* and 205*a*. The material 305 then passes from the fluid passage 205*a* into the interior region 230 of the tubular member 210 below the expansion cone 205. The material 305 then passes from the interior region 230 into the fluid passage 220. The material 305 then exits the apparatus 200 and fills an annular region 310 between the exterior of the tubular member 210 and the interior wall of the new section 130 of the wellbore 100. Continued pumping of the material 305 causes the material 305 to fill up at least a portion of the annular region 310.

The material 305 is preferably pumped into the annular region 310 at pressures and flow rates ranging, for example, from about 0 to 5000 psi and 0 to 1,500 gallons/min, respectively. The optimum flow rate and operating pressures vary as a function of the casing and wellbore sizes, wellbore section length, available pumping equipment, and fluid properties of the fluidic material being pumped. The optimum flow rate and operating pressure are preferably determined using conventional empirical methods.

The hardenable fluidic sealing material 305 may be any number of conventional commercially available hardenable fluidic sealing materials such as, for example, slag mix, cement or epoxy. In a preferred embodiment, the hardenable fluidic sealing material 305 is a blended cement prepared specifically for the particular well section being drilled from Halliburton Energy Services in Dallas, Tex. in order to provide optimal support for tubular member 210 while also maintaining optimum flow characteristics so as to minimize difficulties during the displacement of cement in the annular region 315. The optimum blend of the blended cement is preferably determined using conventional empirical methods. In several alternative embodiments, the hardenable fluidic sealing material 305 is compressible before, during, or after curing.

The annular region 310 preferably is filled with the material 305 in sufficient quantities to ensure that, upon radial expansion of the tubular member 210, the annular region 310 of the new section 130 of the wellbore 100 will be filled with the material 305.

In an alternative embodiment, the injection of the material 305 into the annular region 310 is omitted.

Figure 4:
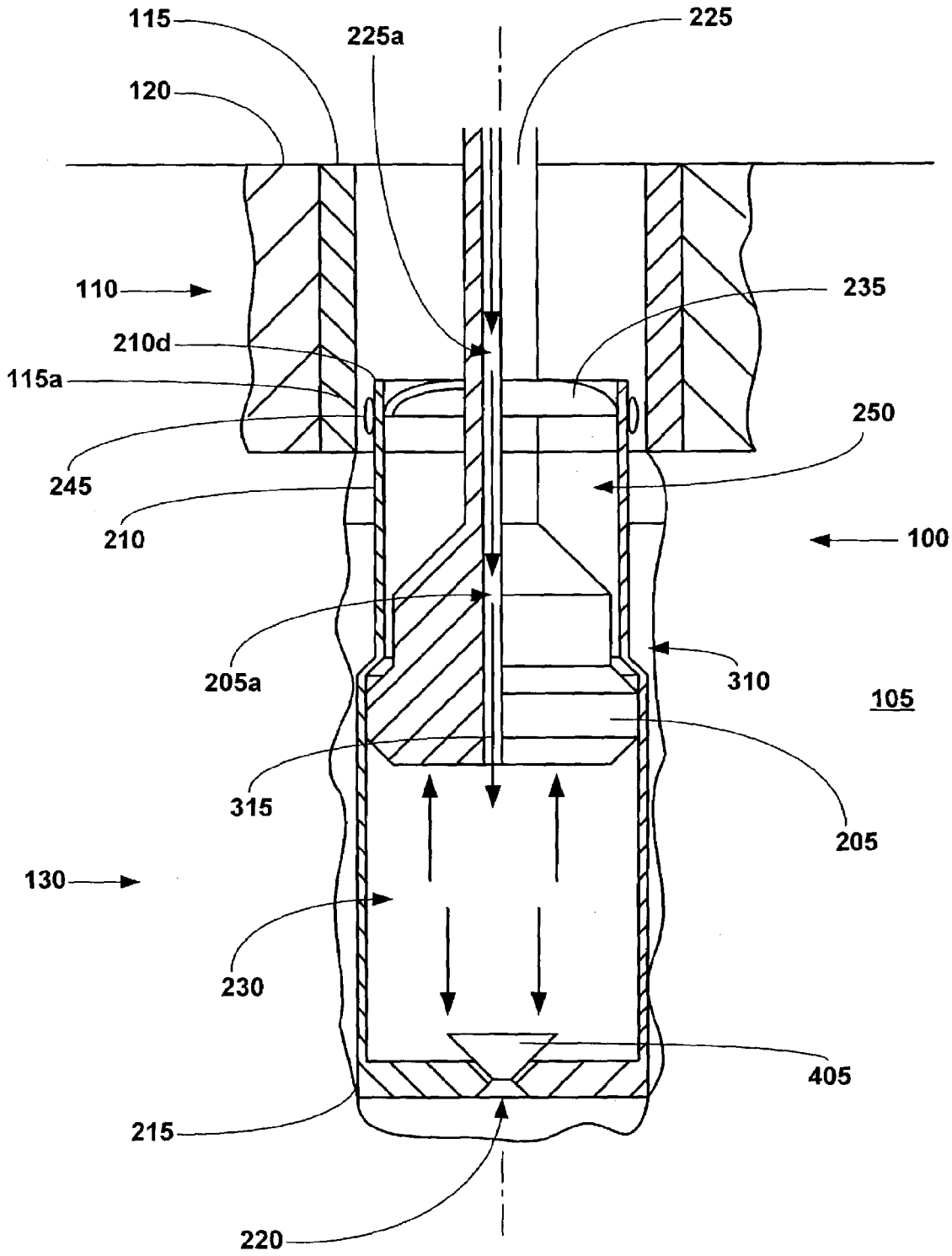
FIG. 4 is a fragmentary cross-sectional view illustrating the injection of a fluidic material into the new section of the well borehole of FIG. 3.

As illustrated in FIG. 4, once the annular region 310 has been adequately filled with the material 305, a plug 405, or other similar device, is introduced into the fluid passage 220, thereby fluidicly isolating the interior region 230 from the annular region 310. In a preferred embodiment, a non-hardenable fluidic material 315 is then pumped into the interior region 230 causing the interior region to pressurize. In this manner, the interior region 230 of the expanded tubular member 210 will not contain significant amounts of cured material 305. This also reduces and simplifies the cost of the entire process. Alternatively, the material 305 may be used during this phase of the process.

Once the interior region 230 becomes sufficiently pressurized, the tubular member 210 is preferably plastically deformed, radially expanded, and extruded off of the expansion cone 205. During the extrusion process, the expansion cone 205 may be raised out of the expanded portion of the tubular member 210. In a preferred embodiment, during the extrusion process, the expansion cone 205 is raised at approximately the same rate as the tubular member 210 is expanded in order to keep the tubular member 210 stationary relative to the new wellbore section 130. In an alternative preferred embodiment, the extrusion process is commenced with the tubular member 210 positioned above the bottom of the new wellbore section 130, keeping the expansion cone 205 stationary, and allowing the tubular member 210 to extrude off of the expansion cone 205 and into the new wellbore section 130 under the force of gravity and the operating pressure of the interior region 230.

The plug 405 is preferably placed into the fluid passage 220 by introducing the plug 405 into the fluid passage 225*a* at a surface location in a conventional manner. The plug 405 preferably acts to fluidicly isolate the hardenable fluidic sealing material 305 from the non hardenable fluidic material 315.

The plug 405 may be any number of conventional commercially available devices from plugging a fluid passage such as, for example, Multiple Stage Cementer (MSC) latch-down plug, Omega latch-down plug or three-wiper latch-down plug modified in accordance with the teachings of the present disclosure. In a preferred embodiment, the plug 405 is a MSC latch-down plug available from Halliburton Energy Services in Dallas, Tex.

After placement of the plug 405 in the fluid passage 220, the non hardenable fluidic material 315 is preferably pumped into the interior region 310 at pressures and flow rates ranging, for example, from approximately 400 to 10,000 psi and 30 to 4,000 gallons/min. In this manner, the amount of hardenable fluidic sealing material within the interior 230 of the tubular member 210 is minimized. In a preferred embodiment, after placement of the plug 405 in the fluid passage 220, the non hardenable material 315 is preferably pumped into the interior region 230 at pressures and flow rates ranging from approximately 500 to 9,000 psi and 40 to 3,000 gallons/min in order to maximize the extrusion speed.

In a preferred embodiment, the apparatus 200 is adapted to minimize tensile, burst, and friction effects upon the tubular member 210 during the expansion process. These effects will be depend upon the geometry of the expansion cone 205, the material composition of the tubular member 210 and expansion cone 205, the inner diameter of the tubular member 210, the wall thickness of the tubular member 210, the type of lubricant, and the yield strength of the tubular member 210. In general, the thicker the wall thickness, the smaller the inner diameter, and the greater the yield strength of the tubular member 210, then the greater the operating pressures required to extrude the tubular member 210 off of the expansion cone 205.

For typical tubular members 210, the extrusion of the tubular member 210 off of the expansion cone 205 will begin when the pressure of the interior region 230 reaches, for example, approximately 500 to 9,000 psi.

During the extrusion process, the expansion cone 205 may be raised out of the expanded portion of the tubular member 210 at rates ranging, for example, from about 0 to 5 ft/sec. In a preferred embodiment, during the extrusion process, the expansion cone 205 is raised out of the expanded portion of the tubular member 210 at rates ranging from about 0 to 2 ft/sec in order to minimize the time required for the expansion process while also permitting easy control of the expansion process.

When the upper end portion 210*d* of the tubular member 210 is extruded off of the expansion cone 205, the outer surface of the upper end portion 210*d* of the tubular member 210 will preferably contact the interior surface of the lower end portion 115*a* of the casing 115 to form an fluid tight overlapping joint. The contact pressure of the overlapping joint may range, for example, from approximately 50 to 20,000 psi. In a preferred embodiment, the contact pressure of the overlapping joint ranges from approximately 400 to 10,000 psi in order to provide optimum pressure to activate the annular sealing members 245 and optimally provide resistance to axial motion to accommodate typical tensile and compressive loads.

The overlapping joint between the existing casing 115 and the radially expanded tubular member 210 preferably provides a gaseous and fluidic seal. In a particularly preferred embodiment, the sealing members 245 optimally provide a fluidic and gaseous seal in the overlapping joint. In an alternative embodiment, the sealing members 245 are omitted.

In a preferred embodiment, the operating pressure and flow rate of the non-hardenable fluidic material 315 is controllably ramped down when the expansion cone 205 reaches the upper end portion 210*d* of the tubular member 210. In this manner, the sudden release of pressure caused by the complete extrusion of the tubular member 210 off of the expansion cone 205 can be minimized. In a preferred embodiment, the operating pressure is reduced in a substantially linear fashion from 100% to about 10% during the end of the extrusion process beginning when the expansion cone 205 is within about 5 feet from completion of the extrusion process.

Alternatively, or in combination, a shock absorber is provided in the support member 225 in order to absorb the shock caused by the sudden release of pressure. The shock absorber may, for example, be any conventional commercially available shock absorber adapted for use in wellbore operations.

Alternatively, or in combination, an expansion cone catching structure is provided in the upper end portion 210*d* of the tubular member 210 in order to catch or at least decelerate the expansion cone 205.

Once the extrusion process is completed, the expansion cone 205 is removed from the wellbore 100. In a preferred embodiment, either before or after the removal of the expansion cone 205, the integrity of the fluidic seal of the overlapping joint between the upper end portion 210*d* of the tubular member 210 and the lower end portion 115*a* of the preexisting wellbore casing 115 is tested using conventional methods.

In a preferred embodiment, if the fluidic seal of the overlapping joint between the upper end portion 210*d* of the tubular member 210 and the lower end portion 115*a* of the casing 115 is satisfactory, then any uncured portion of the material 305 within the expanded tubular member 210 is then removed in a conventional manner such as, for example, circulating the uncured material out of the interior of the expanded tubular member 210. The expansion cone 205 is then pulled out of the wellbore section 130 and a drill bit or mill is used in combination with a conventional drilling assembly 505 to drill out any hardened material 305 within the tubular member 210. In a preferred embodiment, the material 305 within the annular region 310 is then allowed to fully cure.

Figure 5:
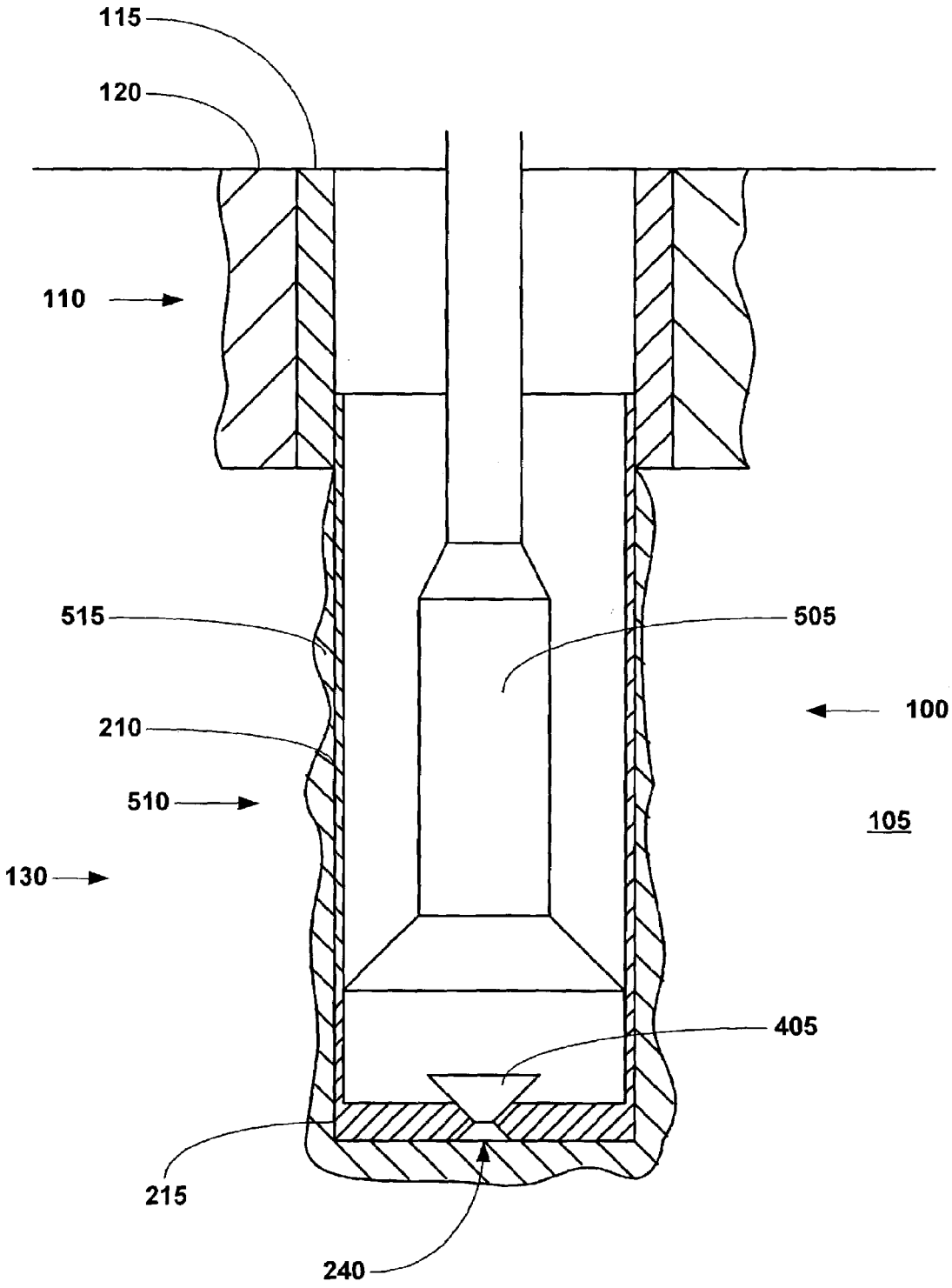
FIG. 5 is a fragmentary cross-sectional view illustrating the drilling out of the cured hardenable fluidic sealing material and the shoe from the new section of the well borehole of FIG. 4.

As illustrated in FIG. 5, preferably any remaining cured material 305 within the interior of the expanded tubular member 210 is then removed in a conventional manner using a conventional drill string 505. The resulting new section of casing 510 preferably includes the expanded tubular member 210 and an outer annular layer 515 of the cured material 305.

Figure 6:
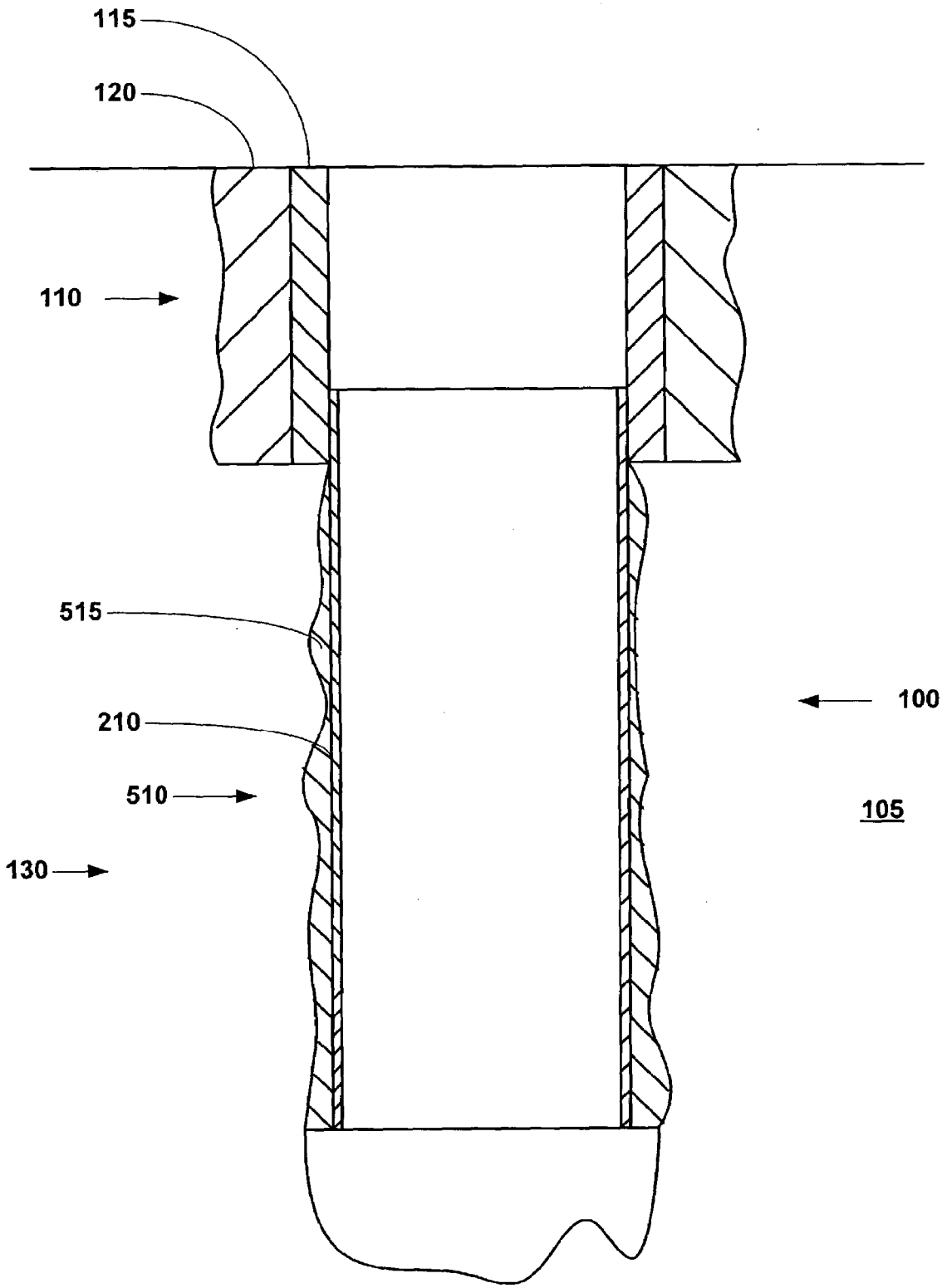
FIG. 6 is a cross-sectional view of the well borehole of FIG. 5 following the drilling out of the shoe.

As illustrated in FIG. 6, the bottom portion of the apparatus 200 including the shoe 215 and dart 405 may then be removed by drilling out the shoe 215 and dart 405 using conventional drilling methods.

Figure 7:
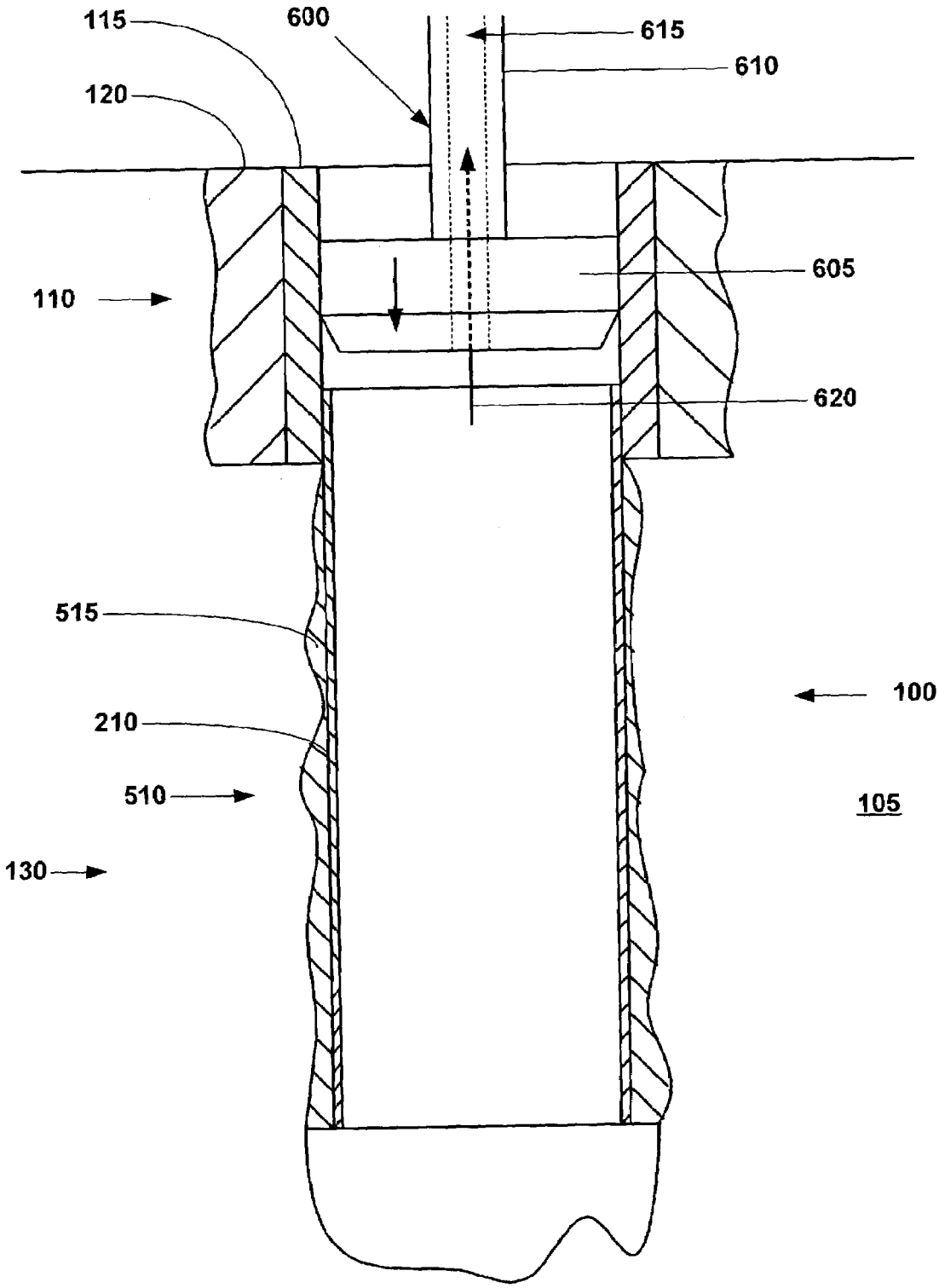
FIG. 7 is a fragmentary cross-sectional view of the placement and actuation of an expansion cone within the well borehole of FIG. 6 for forming a mono-diameter wellbore casing.

As illustrated in FIG. 7, an apparatus 600 for forming a mono-diameter wellbore casing is then positioned within the wellbore casing 115 proximate the tubular member 210 that includes an expansion cone 605 and a support member 610. In a preferred embodiment, the outside diameter of the expansion cone 605 is substantially equal to the inside diameter of the wellbore casing 115. The apparatus 600 preferably further includes a fluid passage 615 for conveying fluidic materials 620 out of the wellbore 100 that are displaced by the placement and operation of the expansion cone 605.

Figure 8:
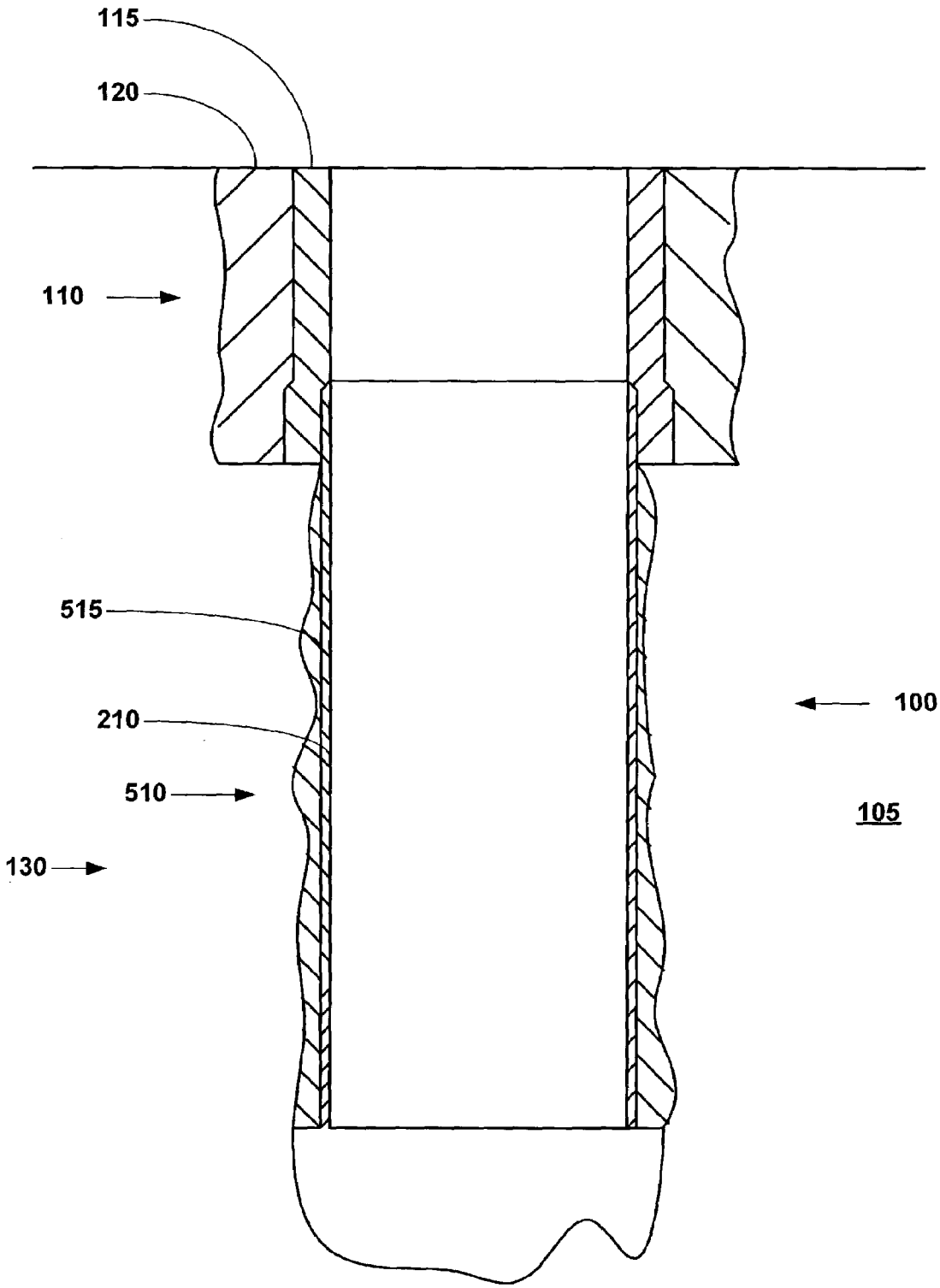
FIG. 8 is a cross-sectional illustration of the well borehole of FIG. 7 following the formation of a mono-diameter wellbore casing.

The expansion cone 605 is then driven downward using the support member 610 in order to radially expand and plastically deform the tubular member 210 and the overlapping portion of the tubular member 115. In this manner, as illustrated in FIG. 8, a mono-diameter wellbore casing is formed that includes the overlapping wellbore casings 115 and 210. In several alternative embodiments, the secondary radial expansion process is performed before, during, or after the material 515 fully cures. In several alternative embodiments, a conventional expansion device including rollers may be substituted for, or used in combination with, the apparatus 600.

Figure 9:
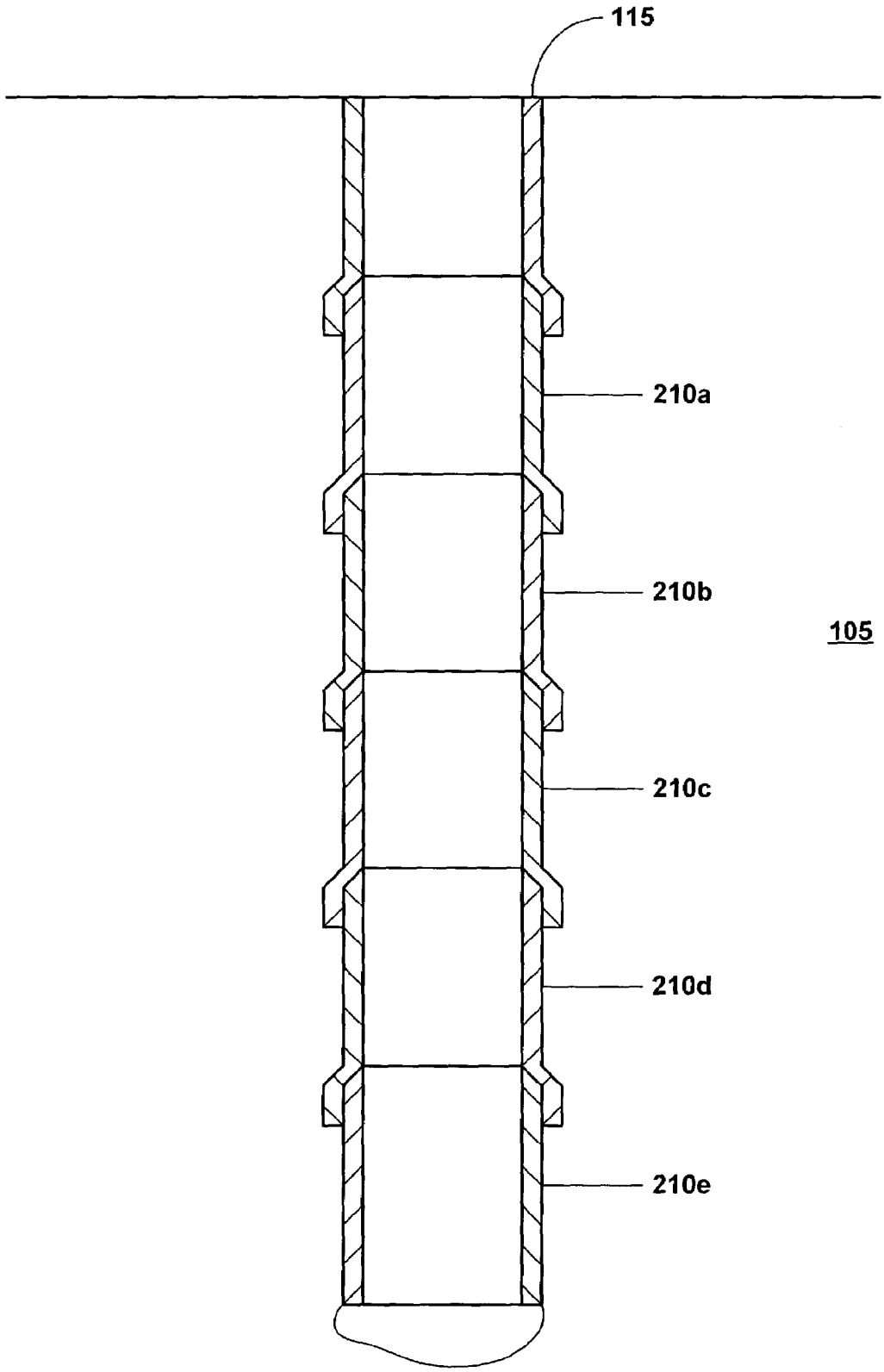
FIG. 9 is a cross-sectional illustration of the well borehole of FIG. 8 following the repeated operation of the methods of FIGS. 1–8 in order to form a mono-diameter wellbore casing including a plurality of overlapping wellbore casings.

More generally, as illustrated in FIG. 9, the method of FIGS. 1–8 is repeatedly performed in order to provide a mono-diameter wellbore casing that includes overlapping wellbore casings 115 and 210*a*–210*e*. The wellbore casing 115, and 210*a*–210*e* preferably include outer annular layers of fluidic sealing material. In this manner, a mono-diameter wellbore casing may be formed within the subterranean formation that extends for tens of thousands of feet. More generally still, the teachings of FIGS. 1–9 may be used to form a mono-diameter wellbore casing, a pipeline, a structural support, or a tunnel within a subterranean formation at any orientation from the vertical to the horizontal.

In a preferred embodiment, the formation of a mono-diameter wellbore casing, as illustrated in FIGS. 1–9, is further provided as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, and (22) U.S. provisional patent application Ser. No. 60/259,486, filed on Jan. 3, 2001, the disclosures of which are incorporated herein by reference.

In an alternative embodiment, the fluid passage 220 in the shoe 215 is omitted. In this manner, the pressurization of the region 230 is simplified. In an alternative embodiment, the annular body 515 of the fluidic sealing material is formed using conventional methods of injecting a hardenable fluidic sealing material into the annular region 310.

Figure 10:
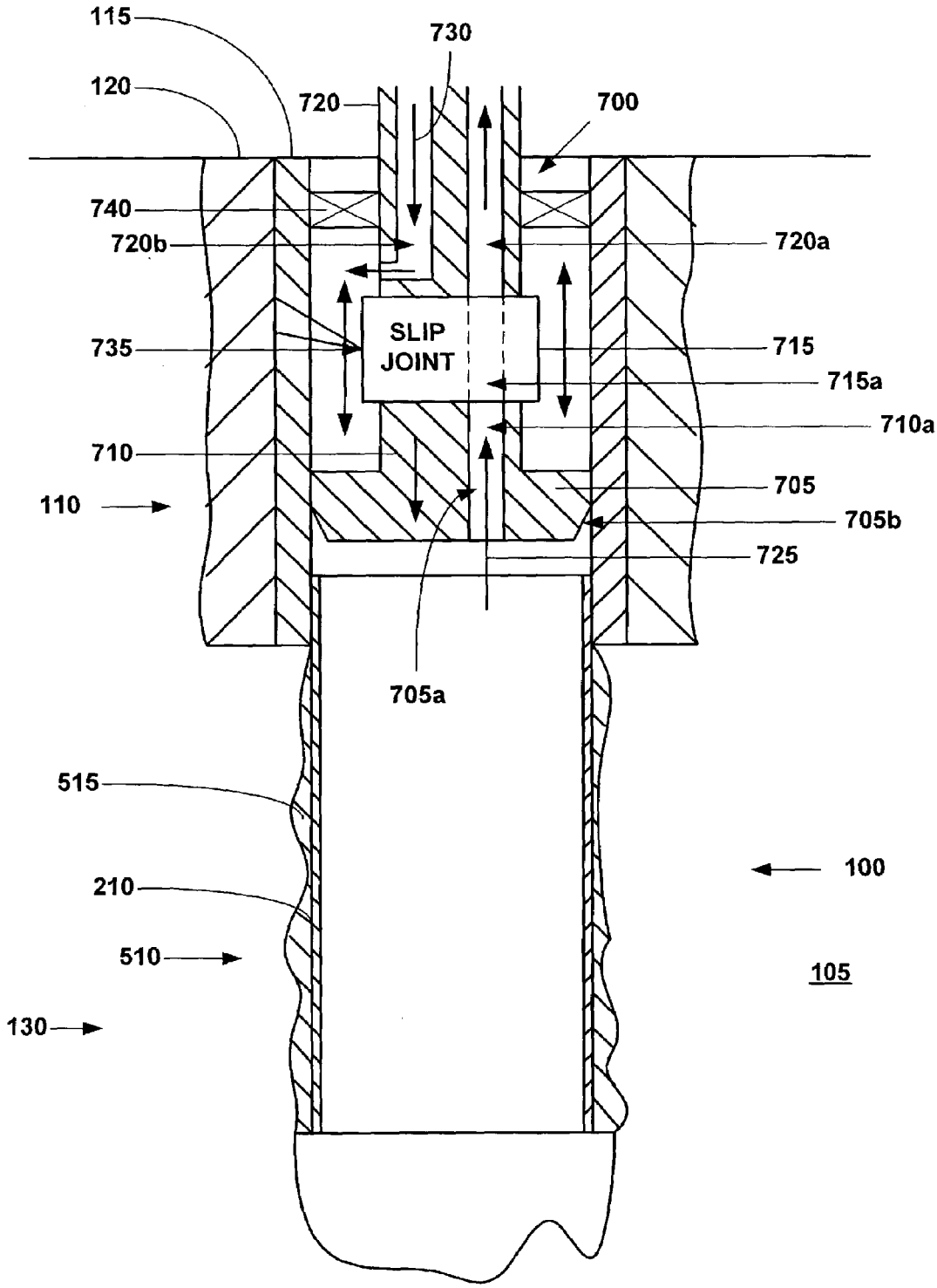
FIG. 10 is a fragmentary cross-sectional illustration of the placement of an alternative embodiment of an apparatus for forming a mono-diameter wellbore casing into the well borehole of FIG. 6.
Figure 11:
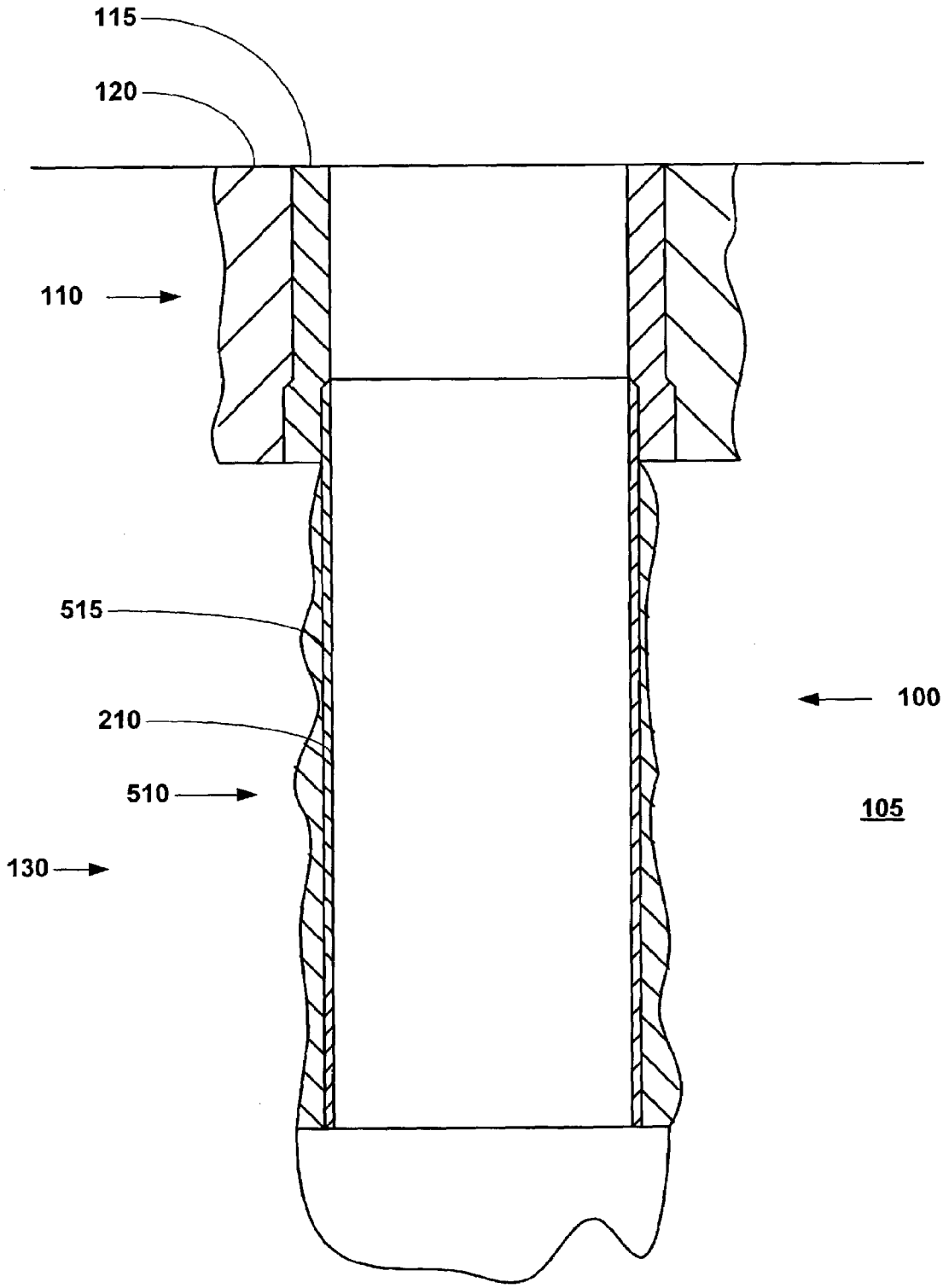
FIG. 11 is a cross-sectional illustration of the well borehole of FIG. 10 following the formation of a mono-diameter wellbore casing.

Referring to FIGS. 10–11, in an alternative embodiment, an apparatus 700 for forming a mono-diameter wellbore casing is positioned within the wellbore casing 115 that includes an expansion cone 705 having a fluid passage 705*a* that is coupled to a support member 710.

The expansion cone 705 preferably further includes a conical outer surface 705*b* for radially expanding and plastically deforming the overlapping portion of the tubular member 115 and the tubular member 210. In a preferred embodiment, the outside diameter of the expansion cone 705 is substantially equal to the inside diameter of the preexisting wellbore casing 115.

The support member 710 is coupled to a slip joint 715, and the slip joint is coupled to a support member 720. As will be recognized by persons having ordinary skill in the art, a slip joint permits relative movement between objects. Thus, in this manner, the expansion cone 705 and support member 710 may be displaced in the longitudinal direction relative to the support member 720. In a preferred embodiment, the slip joint 710 permits the expansion cone 705 and support member 710 to be displaced in the longitudinal direction relative to the support member 720 for a distance greater than or equal to the axial length of the tubular member 210. In this manner, the expansion cone 705 may be used to plastically deform and radially expand the overlapping portion of the tubular member 115 and the tubular member 210 without having to reposition the support member 720.

The slip joint 715 may be any number of conventional commercially available slip joints that include a fluid passage for conveying fluidic materials through the slip joint. In a preferred embodiment, the slip joint 715 is a pumper sub commercially available from Bowen Oil Tools in order to optimally provide elongation of the drill string.

The support member 710, slip joint 715, and support member 720 further include fluid passages 710*a*, 715*a*, and 720*a*, respectively, that are fluidicly coupled to the fluid passage 705*a*. During operation, the fluid passages 705*a*, 710*a*, 715*a*, and 720*a* preferably permit fluidic materials 725 displaced by the expansion cone 705 to be conveyed to a location above the apparatus 700. In this manner, operating pressures within the subterranean formation 105 below the expansion cone are minimized.

The support member 720 further preferably includes a fluid passage 720*b* that permits fluidic materials 730 to be conveyed into an annular region 735 surrounding the support member 710, the slip joint 715, and the support member 720 and bounded by the expansion cone 705 and a conventional packer 740 that is coupled to the support member 720. In this manner, the annular region 735 may be pressurized by the injection of the fluids 730 thereby causing the expansion cone 705 to be displaced in the longitudinal direction relative to the support member 720 to thereby plastically deform and radially expand the overlapping portion of the tubular member 115 and the tubular member 210.

During operation, as illustrated in FIG. 10, in a preferred embodiment, the apparatus 700 is positioned within the preexisting casing 115 with the bottom surface of the expansion cone 705 proximate the top of the tubular member 210. During placement of the apparatus 700 within the preexisting casing 115, fluidic materials 725 within the casing are conveyed out of the casing through the fluid passages 705*a*, 710*a*, 715*a*, and 720*a*. In this manner, surge pressures within the wellbore 100 are minimized.

The packer 740 is then operated in a well-known manner to fluidicly isolate the annular region 735 from the annular region above the packer. The fluidic material 730 is then injected into the annular region 735 using the fluid passage 720*b*. Continued injection of the fluidic material 730 into the annular region 735 preferably pressurizes the annular region and thereby causes the expansion cone 705 and support member 710 to be displaced in the longitudinal direction relative to the support member 720.

As illustrated in FIG. 11, in a preferred embodiment, the longitudinal displacement of the expansion cone 705 in turn plastically deforms and radially expands the overlapping portion of the tubular member 115 and the tubular member 210. In this manner, a mono-diameter wellbore casing is formed that includes the overlapping wellbore casings 115 and 210. The apparatus 700 may then be removed from the wellbore 100 by releasing the packer 740 from engagement with the wellbore casing 115, and lifting the apparatus 700 out of the wellbore 100.

In an alternative embodiment of the apparatus 700, the fluid passage 720*b* is provided within the packer 740 in order to enhance the operation of the apparatus 700.

In an alternative embodiment of the apparatus 700, the fluid passages 705*a*, 710*a*, 715*a*, and 720*a* are omitted. In this manner, in a preferred embodiment, the region of the wellbore 100 below the expansion cone 705 is pressurized and one or more regions of the subterranean formation 105 are fractured to enhance the oil and/or gas recovery process.

Referring to FIGS. 12–15, in an alternative embodiment, an apparatus 800 is positioned within the wellbore casing 115 that includes an expansion cone 805 having a fluid passage 805*a* that is releasably coupled to a releasable coupling 810 having fluid passage 810*a*.

The fluid passage 805*a* is preferably adapted to receive a conventional ball, plug, or other similar device for sealing off the fluid passage. The expansion cone 805 further includes a conical outer surface 805*b* for radially expanding and plastically deforming the overlapping portion of the tubular member 115 and the tubular member 210. In a preferred embodiment, the outside diameter of the expansion cone 805 is substantially equal to the inside diameter of the pre-existing wellbore casing 115.

The releasable coupling 810 may be any number of conventional commercially available releasable couplings that include a fluid passage for conveying fluidic materials through the releasable coupling. In a preferred embodiment, the releasable coupling 810 is a safety joint commercially available from Halliburton in order to optimally release the expansion cone 805 from the support member 815 at a predetermined location.

A support member 815 is coupled to the releasable coupling 810 that includes a fluid passage 815*a*. The fluid passages 805*a*, 810*a* and 815*a* are fluidicly coupled. In this manner, fluidic materials may be conveyed into and out of the wellbore 100.

A packer 820 is movably and sealingly coupled to the support member 815. The packer may be any number of conventional packers. In a preferred embodiment, the packer 820 is a commercially available burst preventer (BOP) in order to optimally provide a sealing member.

Figure 12:
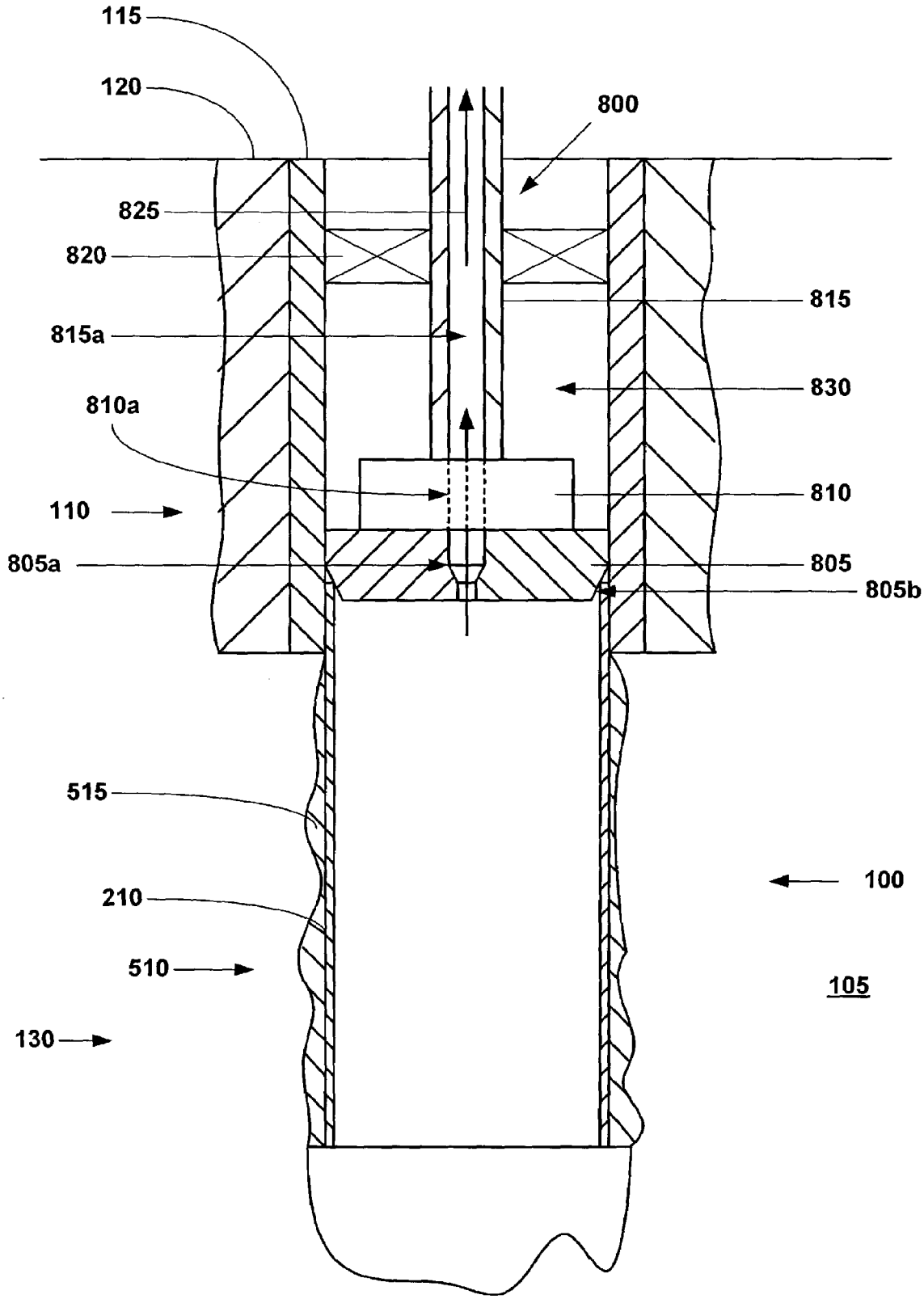
FIG. 12 is a fragmentary cross-sectional illustration of the placement of an alternative embodiment of an apparatus for forming a mono-diameter wellbore casing into the well borehole of FIG. 6.

During operation, as illustrated in FIG. 12, in a preferred embodiment, the apparatus 800 is positioned within the preexisting casing 115 with the bottom surface of the expansion cone 805 proximate the top of the tubular member 210. During placement of the apparatus 800 within the preexisting casing 115, fluidic materials 825 within the casing are conveyed out of the casing through the fluid passages 805*a*, 810*a*, and 815*a*. In this manner, surge pressures within the wellbore 100 are minimized. The packer 820 is then operated in a well-known manner to fluidicly isolate a region 830 within the casing 115 between the expansion cone 805 and the packer 820 from the region above the packer.

Figure 13:
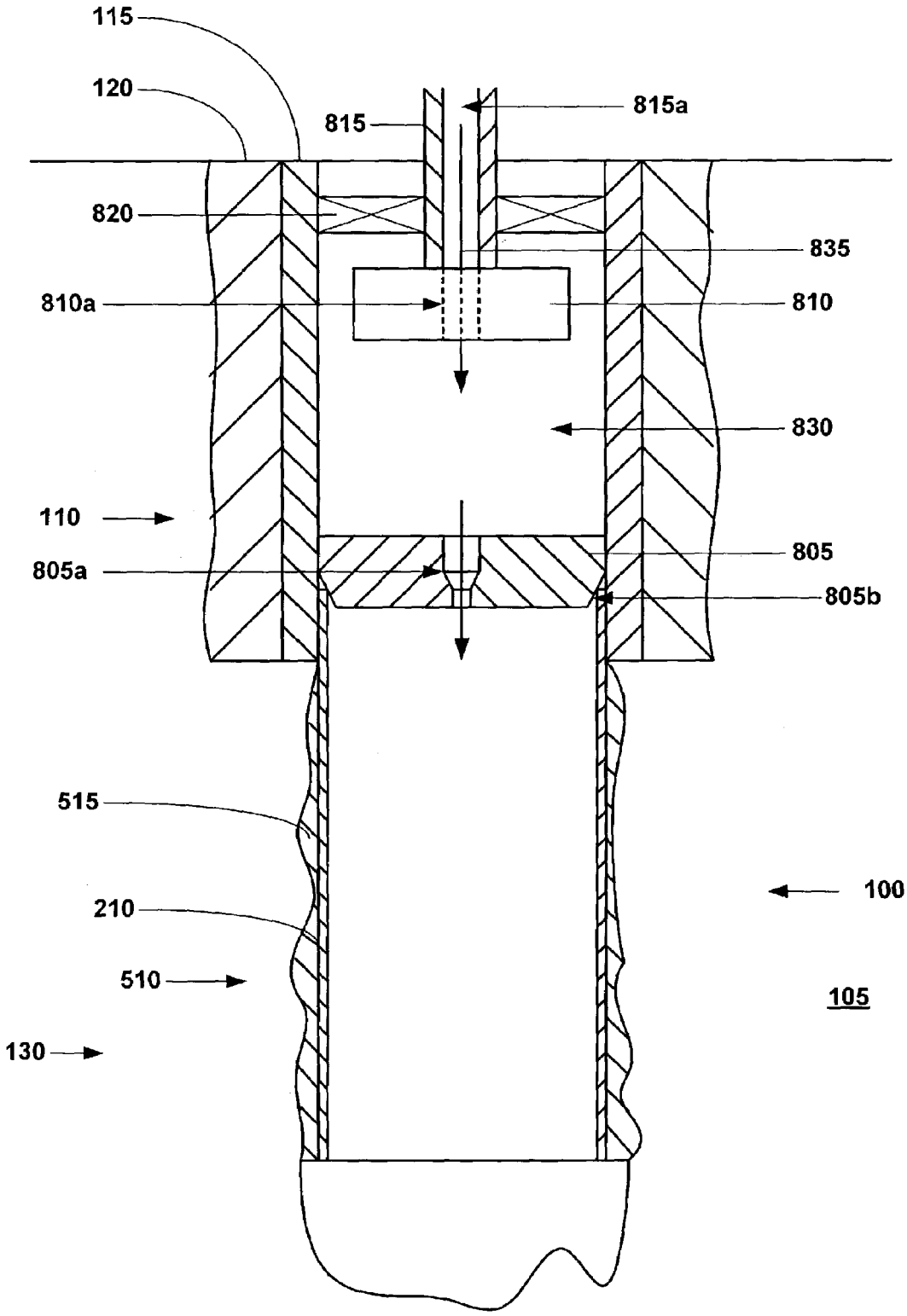
FIG. 13 is a fragmentary cross-sectional illustration of the well borehole of FIG. 12 during the injection of pressurized fluids into the well borehole.

In a preferred embodiment, as illustrated in FIG. 13, the releasable coupling 810 is then released from engagement with the expansion cone 805 and the support member 815 is moved away from the expansion cone. A fluidic material 835 may then be injected into the region 830 through the fluid passages 810*a* and 815*a*. The fluidic material 835 may then flow into the region of the wellbore 100 below the expansion cone 805 through the valveable passage 805*b*. Continued injection of the fluidic material 835 may thereby pressurize and fracture regions of the formation 105 below the tubular member 210. In this manner, the recovery of oil and/or gas from the formation 105 may be enhanced.

Figure 14:
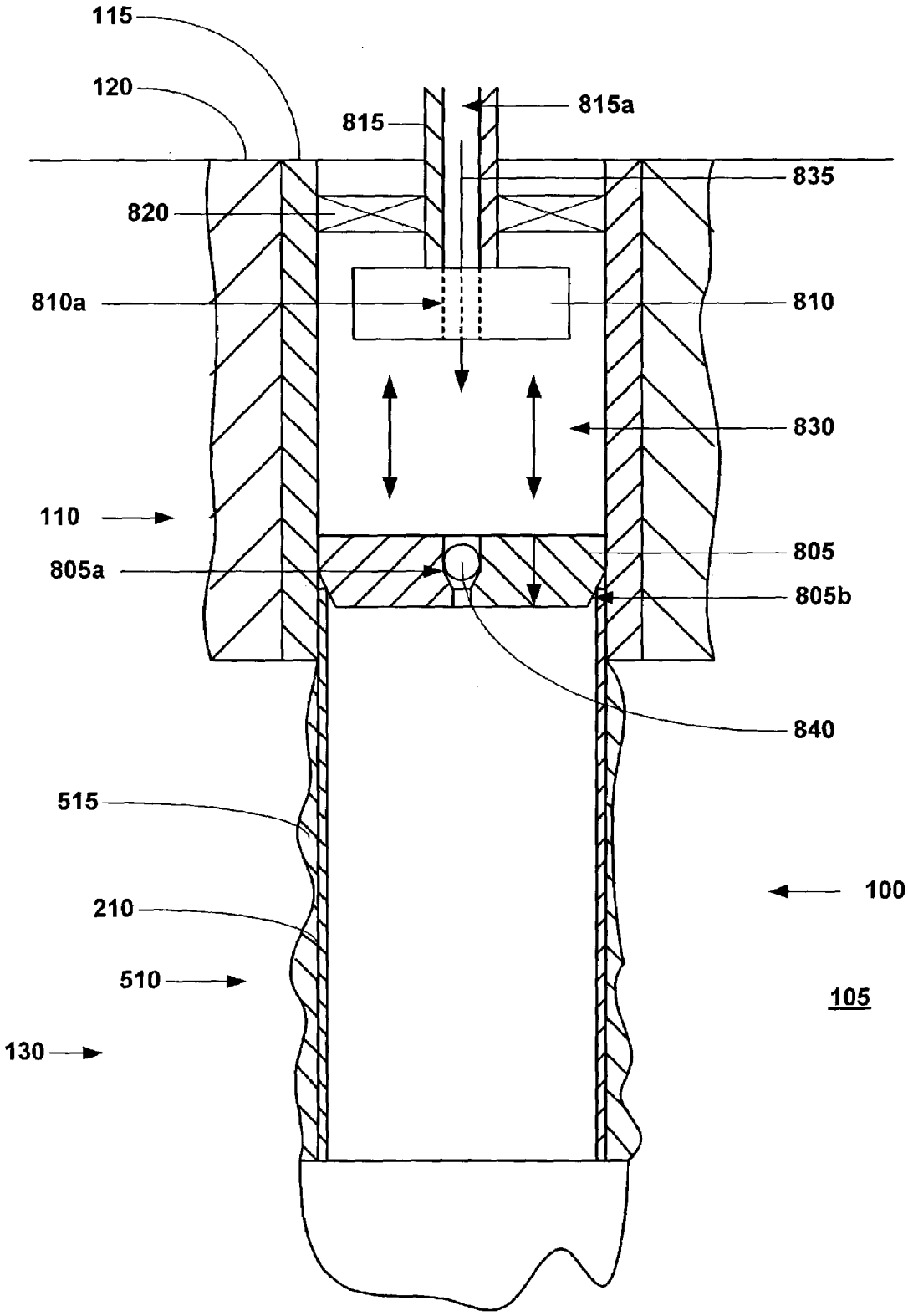
FIG. 14 is a fragmentary cross-sectional illustration of the well borehole of FIG. 13 during the formation of the mono-diameter wellbore casing.

In a preferred embodiment, as illustrated in FIG. 14, a plug, ball, or other similar valve device 840 may then be positioned in the valveable passage 805*a* by introducing the valve device into the fluidic material 835. In this manner, the region 830 may be fluidicly isolated from the region below the expansion cone 805. Continued injection of the fluidic material 835 may then pressurize the region 830 thereby causing the expansion cone 805 to be displaced in the longitudinal direction.

Figure 15:
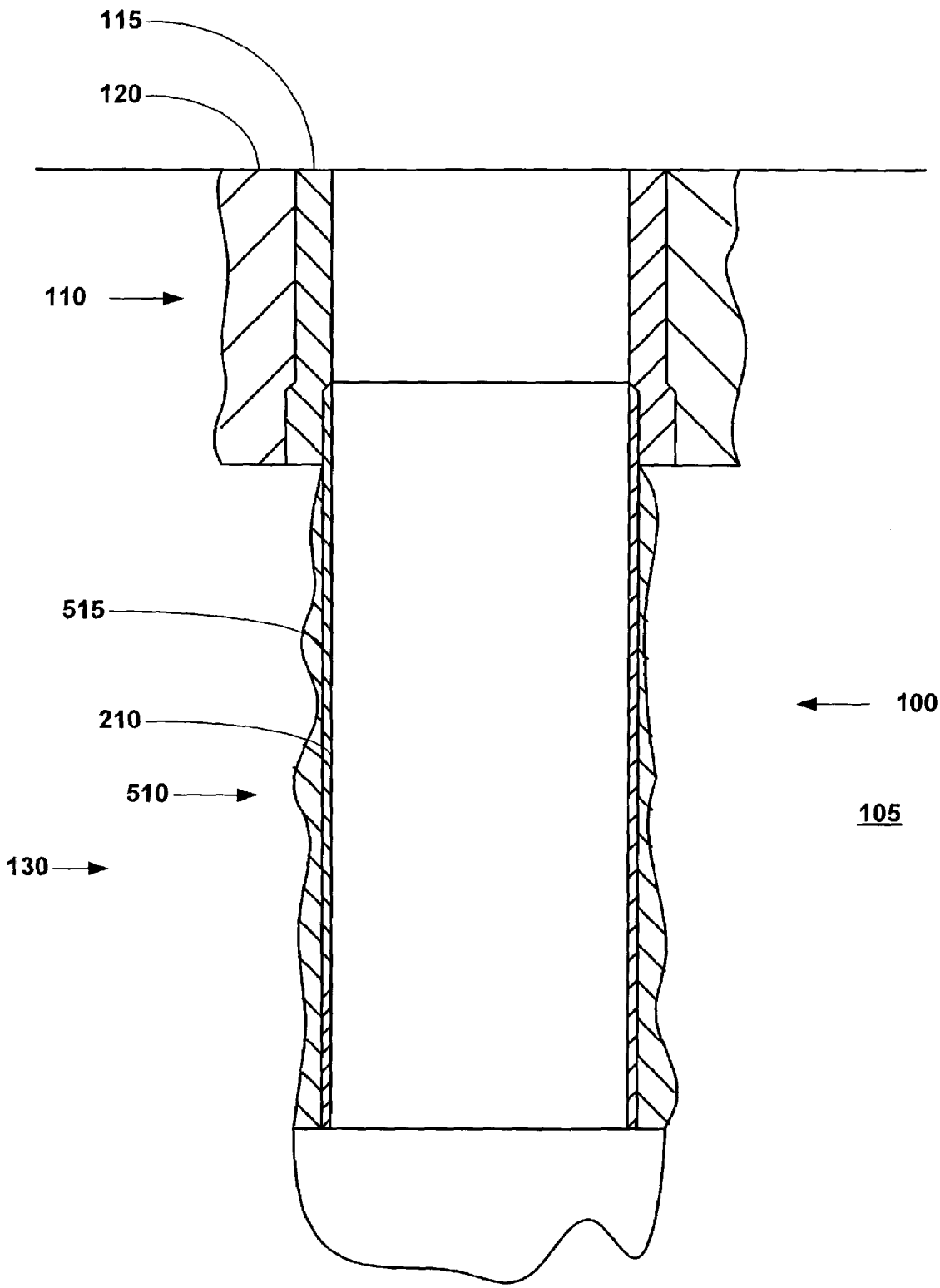
FIG. 15 is a fragmentary cross-sectional illustration of the well borehole of FIG. 14 following the formation of the mono-diameter wellbore casing.

In a preferred embodiment, as illustrated in FIG. 15, the longitudinal displacement of the expansion cone 805 plastically deforms and radially expands the overlapping portion of the pre-existing wellbore casing 115 and the tubular member 210. In this manner, a mono-diameter wellbore casing is formed that includes the pre-existing wellbore casing 115 and the tubular member 210. Upon completing the radial expansion process, the support member 815 may be moved toward the expansion cone 805 and the expansion cone may be re-coupled to the releasable coupling device 810. The packer 820 may then be decoupled from the wellbore casing 115, and the expansion cone 805 and the remainder of the apparatus 800 may then be removed from the wellbore 100.

In a preferred embodiment, the displacement of the expansion cone 805 also pressurizes the region within the tubular member 210 below the expansion cone. In this manner, the subterranean formation surrounding the tubular member 210 may be elastically or plastically compressed thereby enhancing the structural properties of the formation.

A method of creating a mono-diameter wellbore casing in a borehole located in a subterranean formation including a preexisting wellbore casing has been described that includes installing a tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the preexisting wellbore casing and the tubular liner using a second expansion cone. In a preferred embodiment, radially expanding at least a portion of the preexisting wellbore casing and the tubular liner using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the preexisting wellbore casing and the tubular liner using the second expansion cone includes displacing the second expansion cone in a longitudinal direction, and compressing at least a portion of the subterranean formation using fluid pressure. In a preferred embodiment, displacing the second expansion cone in a longitudinal direction includes applying fluid pressure to the second expansion cone. In a preferred embodiment, injecting a hardenable fluidic sealing material into an annulus between the tubular liner and the borehole.

An apparatus for forming a mono-diameter wellbore casing in a borehole located in a subterranean formation including a preexisting wellbore casing has also been described that includes means for installing a tubular liner and a first expansion cone in the borehole, means for injecting a fluidic material into the borehole, means for pressurizing a portion of an interior region of the tubular liner below the first expansion cone, means for radially expanding at least a portion of the tubular liner in the borehole by extruding at least a portion of the tubular liner off of the first expansion cone, and means for radially expanding at least a portion of the preexisting wellbore casing and the tubular liner using a second expansion cone. In a preferred embodiment, the means for radially expanding at least a portion of the preexisting wellbore casing and the tubular liner using the second expansion cone includes means for displacing the second expansion cone in a longitudinal direction, and means for permitting fluidic materials displaced by the second expansion cone to be removed. In a preferred embodiment, the means for displacing the second expansion cone in a longitudinal direction includes means for applying fluid pressure to the second expansion cone. In a preferred embodiment, the means for radially expanding at least a portion of the preexisting wellbore casing and the tubular liner using the second expansion cone includes means for displacing the second expansion cone in a longitudinal direction, and means for compressing at least a portion of the subterranean formation using fluid pressure. In a preferred embodiment, the means for displacing the second expansion cone in a longitudinal direction includes means for applying fluid pressure to the second expansion cone. In a preferred embodiment, the apparatus further includes means for injecting a hardenable fluidic sealing material into an annulus between the tubular liner and the borehole.

A method of joining a second tubular member to a first tubular member positioned within a subterranean formation, the first tubular member having an inner diameter greater than an outer diameter of the second tubular member has also been described that includes positioning a first expansion cone within an interior region of the second tubular member, pressurizing a portion of the interior region of the second tubular member adjacent to the first expansion cone, extruding at least a portion of the second tubular member off of the first expansion cone into engagement with the first tubular member, and radially expanding at least a portion of the first tubular member and the second tubular member using a second expansion cone. In a preferred embodiment, radially expanding at least a portion of the first tubular member and the second tubular member using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the first and second tubular members using the second expansion cone includes displacing the second expansion cone in a longitudinal direction, and compressing at least a portion of the subterranean formation using fluid pressure. In a preferred embodiment, displacing the second expansion cone in a longitudinal direction includes applying fluid pressure to the second expansion cone. In a preferred embodiment, the method further includes injecting a hardenable fluidic sealing material into an annulus around the second tubular member.

An apparatus for joining a second tubular member to a first tubular member positioned within a subterranean formation, the first tubular member having an inner diameter greater than an outer diameter of the second tubular member, has also been described that includes means for positioning a first expansion cone within an interior region of the second tubular member, means for pressurizing a portion of the interior region of the second tubular member adjacent to the first expansion cone, means for extruding at least a portion of the second tubular member off of the first expansion cone into engagement with the first tubular member, and means for radially expanding at least a portion of the first tubular member and the second tubular member using a second expansion cone. In a preferred embodiment, the means for radially expanding at least a portion of the first tubular member and the second tubular member using the second expansion cone includes means for displacing the second expansion cone in a longitudinal direction, and means for permitting fluidic materials displaced by the second expansion cone to be removed. In a preferred embodiment, the means for displacing the second expansion cone in a longitudinal direction includes means for applying fluid pressure to the second expansion cone. In a preferred embodiment, the means for radially expanding at least a portion of the first tubular member and the second tubular member using the second expansion cone includes means for displacing the second expansion cone in a longitudinal direction, and means for compressing at least a portion of the subterranean formation using fluid pressure. In a preferred embodiment, the means for displacing the second expansion cone in a longitudinal direction includes means for applying fluid pressure to the second expansion cone. In a preferred embodiment, the apparatus further includes means for injecting a hardenable fluidic sealing material into an annulus around the second tubular member.

An apparatus has also been described that includes a subterranean formation including a borehole, a wellbore casing coupled to the borehole, and a tubular liner coupled to the wellbore casing. The inside diameters of the wellbore casing and the tubular liner are substantially equal, and the tubular liner is coupled to the wellbore casing by a method that includes installing the tubular liner and a first expansion cone in the borehole, injecting a fluidic material into the borehole, pressurizing a portion of an interior region of the tubular liner below the first expansion cone, radially expanding at least a portion of the tubular liner in the borehole by extruding at least a portion of the tubular liner off of the first expansion cone, and radially expanding at least a portion of the wellbore casing and the tubular liner using a second expansion cone. In a preferred embodiment, radially expanding at least a portion of the wellbore casing and the tubular liner using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the wellbore casing and the tubular liner using the second expansion cone includes displacing the second expansion cone in a longitudinal direction and compressing at least a portion of the subterranean formation using fluid pressure. In a preferred embodiment, displacing the second expansion cone in a longitudinal direction includes applying fluid pressure to the second expansion cone. In a preferred embodiment, the annular layer of the fluidic sealing material is formed by a method that includes injecting a hardenable fluidic sealing material into an annulus between the tubular liner and the borehole.

An apparatus has also been described that includes a subterranean formation including a borehole, a first tubular member coupled to the borehole, and a second tubular member coupled to the wellbore casing. The inside diameters of the first and second tubular members are substantially equal, and the second tubular member is coupled to the first tubular member by a method that includes installing the second tubular member and a first expansion cone in the borehole, injecting a fluidic material into the borehole, pressurizing a portion of an interior region of the second tubular member below the first expansion cone, radially expanding at least a portion of the second tubular member in the borehole by extruding at least a portion of the second tubular member off of the first expansion cone, and radially expanding at least a portion of the first tubular member and the second tubular member using a second expansion cone. In a preferred embodiment, radially expanding at least a portion of the first and second tubular members using the second expansion cone includes displacing the second expansion cone in a longitudinal direction, and permitting fluidic materials displaced by the second expansion cone to be removed. In a preferred embodiment, displacing the second expansion cone in a longitudinal direction includes applying fluid pressure to the second expansion cone. In a preferred embodiment, radially expanding at least a portion of the first and second tubular members using the second expansion cone includes displacing the second expansion cone in a longitudinal direction, and compressing at least a portion of the subterranean formation using fluid pressure. In a preferred embodiment, displacing the second expansion cone in a longitudinal direction includes applying fluid pressure to the second expansion cone. In a preferred embodiment, the annular layer of the fluidic sealing material is formed by a method that includes injecting a hardenable fluidic sealing material into an annulus between the first tubular member and the borehole.

An apparatus for radially expanding an overlapping joint between a wellbore casing and a tubular liner has also been described that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

A method of radially expanding an overlapping joint between a wellbore casing and a tubular liner has also been described that includes positioning an expansion cone within the wellbore casing above the overlapping joint, sealing off an annular region within the wellbore casing above the expansion cone, displacing the expansion cone by pressurizing the annular region, and removing fluidic materials displaced by the expansion cone from the tubular liner. In a preferred embodiment, the method further includes supporting the expansion cone during the displacement of the expansion cone.

An apparatus for radially expanding an overlapping joint between a wellbore casing and a tubular liner has also been described that includes means for positioning an expansion cone within the wellbore casing above the overlapping joint, means for sealing off an annular region within the wellbore casing above the expansion cone, means for displacing the expansion cone by pressurizing the annular region, and means for removing fluidic materials displaced by the expansion cone from the tubular liner. In a preferred embodiment, the apparatus further includes means for supporting the expansion cone during the displacement of the expansion cone.

An apparatus for radially expanding an overlapping joint between a wellbore casing and a tubular liner has also been described that includes a tubular support including a first passage, a sealing member coupled to the tubular support, a releasable latching member coupled to the tubular support, and an expansion cone releasably coupled to the releasable latching member including a second passage fluidicly coupled to the first passage.

A method of radially expanding an overlapping joint between a wellbore casing and a tubular liner has also been described that includes positioning an expansion cone within the wellbore casing above the overlapping joint, sealing off a region within the wellbore casing above the expansion cone, releasing the expansion cone, and displacing the expansion cone by pressurizing the annular region. In a preferred embodiment, the method further includes pressurizing the interior of the tubular liner.

An apparatus for radially expanding an overlapping joint between a wellbore casing and a tubular liner has also been described that includes means for positioning an expansion cone within the wellbore casing above the overlapping joint, means for sealing off a region within the wellbore casing above the expansion cone, means for releasing the expansion cone, and means for displacing the expansion cone by pressurizing the annular region. In a preferred embodiment, the apparatus further includes means for pressurizing the interior of the tubular liner.

An apparatus for radially expanding an overlapping joint between first and second tubular members has also been described that includes a tubular support including first and second passages, a sealing member coupled to the tubular support, a slip joint coupled to the tubular support including a third passage fluidicly coupled to the second passage, and an expansion cone coupled to the slip joint including a fourth passage fluidicly coupled to the third passage.

A method of radially expanding an overlapping joint between first and second tubular members has also been described that includes positioning an expansion cone within the first tubular member above the overlapping joint, sealing off an annular region within the first tubular member above the expansion cone, displacing the expansion cone by pressurizing the annular region, and removing fluidic materials displaced by the expansion cone from the second tubular member. In a preferred embodiment, the method further includes supporting the expansion cone during the displacement of the expansion cone.

An apparatus for radially expanding an overlapping joint between first and second tubular members has also been described that includes means for positioning an expansion cone within the first tubular member above the overlapping joint, means for sealing off an annular region within the first tubular member above the expansion cone, means for displacing the expansion cone by pressurizing the annular region, and means for removing fluidic materials displaced by the expansion cone from the second tubular member. In a preferred embodiment, the apparatus further includes means for supporting the expansion cone during the displacement of the expansion cone.

An apparatus for radially expanding an overlapping joint between first and second tubular members has also been described that includes a tubular support including a first passage, a sealing member coupled to the tubular support, a releasable latching member coupled to the tubular support, and an expansion cone releasably coupled to the releasable latching member including a second passage fluidicly coupled to the first passage.

A method of radially expanding an overlapping joint between first and second tubular members has also been described that includes positioning an expansion cone within the first tubular member above the overlapping joint, sealing off a region within the first tubular member above the expansion cone, releasing the expansion cone, and displacing the expansion cone by pressurizing the annular region. In a preferred embodiment, the method further includes pressurizing the interior of the second tubular member.

An apparatus for radially expanding an overlapping joint between first and second tubular members has also been described that includes means for positioning an expansion cone within the first tubular member above the overlapping joint, means for sealing off a region within the first tubular member above the expansion cone, means for releasing the expansion cone, and means for displacing the expansion cone by pressurizing the annular region. In a preferred embodiment, the apparatus further includes means for pressurizing the interior of the second tubular member.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. A method of creating a mono-diameter wellbore casing in a borehole located in a subterranean formation including a preexisting wellbore casing, comprising:

installing a tubular liner and a first expansion cone in the borehole;

injecting a fluidic material into the borehole;

pressurizing a portion of an interior region of the tubular liner below the first expansion cone;

radially expanding at least a portion of the tubular liner in the borehole by extruding at least a portion of the tubular liner off of the first expansion cone; and radially expanding at least a portion of the preexisting wellbore casing and the tubular liner using a second expansion cone.

2. The method of claim 1, wherein radially expanding at least a portion of the preexisting wellbore casing and the tubular liner using the second expansion cone comprises:

displacing the second expansion cone in a longitudinal direction; and permitting fluidic materials displaced by the second expansion cone to be removed.

3. The method of claim 2, wherein displacing the second expansion cone in a longitudinal direction comprises:

applying fluid pressure to the second expansion cone.

4. The method of claim 1, wherein radially expanding at least a portion of the preexisting wellbore casing and the tubular liner using the second expansion cone comprises:

displacing the second expansion cone in a longitudinal direction; and compressing at least a portion of the subterranean formation using fluid pressure.

5. The method of claim 4, wherein displacing the second expansion cone in a longitudinal direction comprises:

applying fluid pressure to the second expansion cone.

6. The method of claim 1, further comprising:

injecting a hardenable fluidic sealing material into an annulus between the tubular liner and the borehole.

7. The method of claim 1, wherein the inside diameter of the portion of the tubular liner radially expanded by the first expansion cone is equal to the inside diameter of the portion of the preexisting wellbore casing that was not radially expanded by the second expansion cone.

8. An apparatus for forming a mono-diameter wellbore casing in a borehole located in a subterranean formation including a preexisting wellbore casing, comprising:

means for installing a tubular liner and a first expansion cone in the borehole;

means for injecting a fluidic material into the borehole;

means for pressurizing a portion of an interior region of the tubular liner below the first expansion cone;

means for radially expanding at least a portion of the tubular liner in the borehole by extruding at least a portion of the tubular liner off of the first expansion cone; and means for radially expanding at least a portion of the preexisting wellbore casing and the tubular liner using a second expansion cone.

9. The apparatus of claim 8, wherein the means for radially expanding at least a portion of the preexisting wellbore casing and the tubular liner using the second expansion cone comprises:

means for displacing the second expansion cone in a longitudinal direction; and means for permitting fluidic materials displaced by the second expansion cone to be removed.

10. The apparatus of claim 9, wherein the means for displacing the second expansion cone in a longitudinal direction comprises:

means for applying fluid pressure to the second expansion cone.

11. The apparatus of claim 8, wherein the means for radially expanding at least a portion of the preexisting wellbore casing and the tubular liner using the second expansion cone comprises:

means for displacing the second expansion cone in a longitudinal direction; and means for compressing at least a portion of the subterranean formation using fluid pressure.

12. The apparatus of claim 11, wherein the means for displacing the second expansion cone in a longitudinal direction comprises:

means for applying fluid pressure to the second expansion cone.

13. The apparatus of claim 8, further comprising:

means for injecting a hardenable fluidic sealing material into an annulus between the tubular liner and the borehole.

14. The apparatus of claim 8, wherein the inside diameter of the portion of the tubular liner radially expanded by the first expansion cone is equal to the inside diameter of the portion of the preexisting wellbore casing that was not radially expanded by the second expansion cone.

15. A method of joining a second tubular member to a first tubular member positioned within a subterranean formation, the first tubular member having an inner diameter greater than an outer diameter of the second tubular member, comprising:

positioning a first expansion cone within an interior region of the second tubular member;

pressurizing a portion of the interior region of the second tubular member adjacent to the first expansion cone;

extruding at least a portion of the second tubular member off of the first expansion cone into engagement with the first tubular member; and radially expanding at least a portion of the first tubular member and the second tubular member using a second expansion cone.

16. The method of claim 15, wherein radially expanding at least a portion of the first tubular member and the second tubular member using the second expansion cone comprises:

displacing the second expansion cone in a longitudinal direction; and permitting fluidic materials displaced by the second expansion cone to be removed.

17. The method of claim 16, wherein displacing the second expansion cone in a longitudinal direction comprises:

applying fluid pressure to the second expansion cone.

18. The method of claim 15, wherein radially expanding at least a portion of the first and second tubular members using the second expansion cone comprises:

displacing the second expansion cone in a longitudinal direction; and compressing at least a portion of the subterranean formation using fluid pressure.

19. The method of claim 18, wherein displacing the second expansion cone in a longitudinal direction comprises:

applying fluid pressure to the second expansion cone.

20. The method of claim 15, further comprising:

injecting a hardenable fluidic sealing material into an annulus around the second tubular member.

21. The method of claim 15, wherein the inside diameter of the portion of the tubular liner extruded off of the first expansion cone is equal to the inside diameter of the portion of the preexisting wellbore casing that was not radially expanded by the second expansion cone.

22. An apparatus for joining a second tubular member to a first tubular member positioned within a subterranean formation, the first tubular member having an inner diameter greater than an outer diameter of the second tubular member, comprising:

means for positioning a first expansion cone within an interior region of the second tubular member;

means for pressurizing a portion of the interior region of the second tubular member adjacent to the first expansion cone;

means for extruding at least a portion of the second tubular member off of the first expansion cone into engagement with the first tubular member; and means for radially expanding at least a portion of the first tubular member and the second tubular member using a second expansion cone.

23. The apparatus of claim 22, wherein the means for radially expanding at least a portion of the first tubular member and the second tubular member using the second expansion cone comprises:

means for displacing the second expansion cone in a longitudinal direction; and means for permitting fluidic materials displaced by the second expansion cone to be removed.

24. The apparatus of claim 23, wherein the means for displacing the second expansion cone in a longitudinal direction comprises:

means for applying fluid pressure to the second expansion cone.

25. The apparatus of claim 22, wherein the means for radially expanding at least a portion of the first tubular member and the second tubular member using the second expansion cone comprises:

means for displacing the second expansion cone in a longitudinal direction; and means for compressing at least a portion of the subterranean formation using fluid pressure.

26. The apparatus of claim 25, wherein the means for displacing the second expansion cone in a longitudinal direction comprises:

means for applying fluid pressure to the second expansion cone.

27. The apparatus of claim 22, further comprising:

means for injecting a hardenable fluidic sealing material into an annulus around the second tubular member.

28. The apparatus of claim 22, wherein the inside diameter of the portion of the tubular liner extruded off of the first expansion cone is equal to the inside diameter of the portion of the preexisting wellbore casing that was not radially expanded by the second expansion cone.

29. An apparatus for radially expanding an overlapping joint between a wellbore casing and a tubular liner, comprising:

a tubular support including first and second passages;

a sealing member coupled to the tubular support;

a slip joint coupled to the tubular support including a third passage fluidicly coupled to the second passage; and an expansion cone coupled to the slip joint including a fourth passage fluidicly coupled to the third passage.

30. A method of radially expanding an overlapping joint between a wellbore casing and a tubular liner, comprising:

positioning an expansion cone within the wellbore casing above the overlapping joint;

sealing off an annular region within the wellbore casing above the expansion cone;

displacing the expansion cone by pressurizing the annular region; and removing fluidic materials displaced by the expansion cone from the tubular liner.

31. The method of claim 30, further comprising:

supporting the expansion cone during the displacement of the expansion cone.

32. An apparatus for radially expanding an overlapping joint between a wellbore casing and a tubular liner, comprising:

means for positioning an expansion cone within the wellbore casing above the overlapping joint;

means for sealing off an annular region within the wellbore casing above the expansion cone;

means for displacing the expansion cone by pressurizing the annular region; and means for removing fluidic materials displaced by the expansion cone from the tubular liner.

33. The apparatus of claim 32, further comprising:

means for supporting the expansion cone during the displacement of the expansion cone.

34. An apparatus for radially expanding an overlapping joint between a wellbore casing and a tubular liner, comprising:

a tubular support including a first passage;

a sealing member coupled to the tubular support;

a releasable latching member coupled to the tubular support; and an expansion cone releasably coupled to the releasable latching member including a second passage fluidicly coupled to the first passage.

35. A method of radially expanding an overlapping joint between a wellbore casing and a tubular liner, comprising:

positioning an expansion cone within the wellbore casing above the overlapping joint;

scaling off a region within the wellbore casing above the expansion cone;

releasing the expansion cone; and displacing the expansion cone by pressurizing the annular region.

36. The method of claim 35, further comprising:

pressurizing the interior of the tubular liner.

37. An apparatus for radially expanding an overlapping joint between a wellbore casing and a tubular liner, comprising:

means for positioning an expansion cone within the wellbore casing above the overlapping joint;

means for sealing off a region within the wellbore casing above the expansion cone;

means for releasing the expansion cone; and means for displacing the expansion cone by pressurizing the annular region.

38. The apparatus of claim 37, further comprising:

means for pressurizing the interior of the tubular liner.

39. An apparatus for radially expanding an overlapping joint between first and second tubular members, comprising:

a tubular support including first and second passages;

a sealing member coupled to the tubular support;

a slip joint coupled to the tubular support including a third passage fluidicly coupled to the second passage; and an expansion cone coupled to the slip joint including a fourth passage fluidicly coupled to the third passage.

40. A method of radially expanding an overlapping joint between first and second tubular members, comprising:

positioning an expansion cone within the first tubular member above the overlapping joint;

sealing off an annular region within the first tubular member above the expansion cone;

displacing the expansion cone by pressurizing the annular region; and removing fluidic materials displaced by the expansion cone from the second tubular member.

41. The method of claim 40, further comprising:

supporting the expansion cone during the displacement of the expansion cone.

42. An apparatus for radially expanding an overlapping joint between first and second tubular members, comprising:

means for positioning an expansion cone within the first tubular member above the overlapping joint;

means for sealing off an annular region within the first tubular member above the expansion cone;

means for displacing the expansion cone by pressurizing the annular region; and means for removing fluidic materials displaced by the expansion cone from the second tubular member.

43. The apparatus of claim 42, further comprising:

means for supporting the expansion cone during the displacement of the expansion cone.

44. An apparatus for radially expanding an overlapping joint between first and second tubular members, comprising:

a tubular support including a first passage;

a sealing member coupled to the tubular support;

a releasable latching member coupled to the tubular support; and an expansion cone releasably coupled to the releasable latching member including a second passage fluidicly coupled to the first passage.

45. A method of radially expanding an overlapping joint between first and second tubular members, comprising:

positioning an expansion cone within the first tubular member above the overlapping joint;

sealing off a region within the first tubular member above the expansion cone;

releasing the expansion cone; and displacing the expansion cone by pressurizing the annular region.

46. The method of claim 45, further comprising:

pressurizing the interior of the second tubular member.

47. An apparatus for radially expanding an overlapping joint between first and second tubular members, comprising:

means for positioning an expansion cone within the first tubular member above the overlapping joint;

means for sealing off a region within the first tubular member above the expansion cone;

means for releasing the expansion cone; and means for displacing the expansion cone by pressurizing the annular region.

48. The apparatus of claim 47, further comprising:

means for pressurizing the interior of the second tubular member.

49. A method ofjoining a second pipeline member to a first pipeline member, the first pipeline member having an inner diameter greater than an outer diameter of the second pipeline member, comprising:

positioning a first expansion cone within an interior region of the second pipeline member;

pressurizing a portion of the interior region of the second pipeline member adjacent to the first expansion cone;

extruding at least a portion of the second pipeline member off of the first expansion cone into engagement with the first pipeline member; and radially expanding at least a portion of the first pipeline member and the second pipeline member using a second expansion cone.

50. An apparatus for radially expanding an overlapping joint between a first pipeline member and a second pipeline member, comprising:

a tubular support including first and second passages;

a sealing member coupled to the tubular support;

a slip joint coupled to the tubular support including a third passage fluidicly coupled to the second passage; and an expansion cone coupled to the slip joint including a fourth passage fluidicly coupled to the third passage.

51. A method of joining a second tubular member to a first tubular member, the first tubular member having an inner diameter greater than an outer diameter of the second tubular member, comprising:

positioning a first expansion cone within an interior region of the second tubular member;

pressurizing a portion of the interior region of the second tubular member adjacent to the first expansion cone;

extruding at least a portion of the second tubular member off of the first expansion cone into engagement with the first tubular member; and radially expanding at least a portion of the first tubular member and the second tubular member using a second expansion cone.

52. A method of creating a wellbore casing in a borehole located in a subterranean formation including a preexisting wellbore casing, comprising:

installing a tubular liner and a first expansion cone in the borehole;

injecting a fluidic material into the borehole;

pressurizing a portion of an interior region of the tubular liner below the first expansion cone;

radially expanding at least a portion of the tubular liner in the borehole by extruding at least a portion of the tubular liner off of the first expansion cone; and radially expanding at least a portion of at least one of the preexisting wellbore casing and the tubular liner using a second expansion cone.

53. The method of claim 52 wherein radially expanding at least a portion of the tubular liner in the borehole by extruding at least a portion of the tubular liner off of the first expansion cone comprises displacing the first expansion cone in a first longitudinal direction, and wherein radially expanding at least a portion of at least one of the preexisting wellbore casing and the tubular liner using the second expansion cone comprises displacing the second expansion cone in a second longitudinal direction.

54. The method of claim 53 wherein the first and second longitudinal directions are substantially opposite.

* * * * *